US008113635B2

(12) United States Patent
Yamashita et al.

(10) Patent No.: US 8,113,635 B2
(45) Date of Patent: Feb. 14, 2012

(54) LIQUID DISCHARGE APPARATUS AND CHECK METHOD OF THE SAME

(75) Inventors: Toru Yamashita, Tokai (JP); Yoshitsugu Morita, Nagoya (JP); Tomoyuki Kubo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 936 days.

(21) Appl. No.: 12/014,441

(22) Filed: Jan. 15, 2008

(65) Prior Publication Data

US 2008/0211883 A1 Sep. 4, 2008

(30) Foreign Application Priority Data

Jan. 16, 2007 (JP) ..... 2007-006797
Mar. 7, 2007 (JP) ..... 2007-056632

(51) Int. Cl.
*B41J 2/045* (2006.01)

(52) U.S. Cl. ..... 347/72

(58) Field of Classification Search ..... 347/72
See application file for complete search history.

(56) References Cited

U.S. PATENT DOCUMENTS

| | | | | |
|---|---|---|---|---|
| 5,639,508 | A * | 6/1997 | Okawa et al. | 427/100 |
| 6,431,691 | B1 | 8/2002 | Tanikawa et al. | |
| 6,648,455 | B2 | 11/2003 | Takagi | |
| 6,672,714 | B2 | 1/2004 | Tanikawa et al. | |
| 6,837,560 | B2 | 1/2005 | Ebisawa | |
| 6,932,464 | B2 | 8/2005 | Tanikawa et al. | |
| 7,100,254 | B2 | 9/2006 | Tanikawa et al. | |

FOREIGN PATENT DOCUMENTS

| | | | |
|---|---|---|---|
| JP | 2000252491 | A | 9/2000 |
| JP | 2001308501 | A | 11/2001 |
| JP | 2002059547 | A | 2/2002 |
| JP | 2003080709 | A | 3/2003 |
| JP | 2003323116 | A | 11/2003 |
| JP | 200458663 | A | 2/2004 |
| JP | 2007021854 | A | 2/2007 |
| JP | 2007021855 | A | 2/2007 |
| JP | 2007263220 | A | 10/2007 |
| WO | 9942292 | A1 | 8/1999 |

* cited by examiner

*Primary Examiner* — Jerry Rahll
(74) *Attorney, Agent, or Firm* — Baker Botts L.L.P.

(57) ABSTRACT

A piezoelectric actuator has a first ceramic layer covering openings of pressure chambers, a first electrode provided over the plurality of pressure chambers, a second ceramic layer, a second electrode, a third ceramic layer and a third electrode in this order from the side of the pressure chambers. By measuring insulation resistance between a cavity unit and the first electrode in the state where ink is filled into the pressure chambers, a defect in the ceramic layer is detected.

13 Claims, 18 Drawing Sheets

LIQUID DISCHARGE APPARATUS AND CHECK METHOD OF THE SAME

CROSS-REFERENCE TO RELATED APPLICATIONS

This Non-provisional application claims priority under 35 U.S.C. §119(a) on Patent Application No. 2007-006797 filed in Japan on Jan. 16, 2007 and Patent Application No. 2007-056632 filed in Japan on Mar. 7, 2007, the entire contents of which are hereby incorporated by reference.

TECHNICAL FIELD

The present invention relates to a liquid discharge apparatus, in particular, a liquid discharge apparatus in which a piezoelectric actuator applies discharge pressure to liquid filled into a pressure chamber of a cavity unit, and a check method of the apparatus.

BACKGROUND

Conventionally, in a liquid discharge apparatus, for example, an ink jet head disclosed in Japanese Patent Application Laid-Open No. 2002-59547, a piezoelectric actuator is disposed as opposed to a pressure chamber of a cavity unit and capacity of the pressure chamber is changed by displacement of the piezoelectric actuator, thereby discharging ink.

FIG. 1 schematically shows an ink jet head 910. In a piezoelectric actuator 921, a plurality of ceramic layers 962 are stacked with individual electrodes 952 and common electrodes 953 interposed alternately, and a region of the ceramic layer 962 sandwiched between the individual electrode 952 and the common electrode 953 in the vertical direction is an activated part. By grounding the common electrode 953 and selectively applying voltage to the individual electrode 952, the corresponding activated part is displaced, thereby applying discharge pressure to liquid in a pressure chamber 924.

Since the piezoelectric actuator 921 is generally formed by laminating green sheets made of ceramics such as PZT and sintering them, a minute defect (crack) 960 is easy to occur in the ceramic layer 962 as a sintered body. When, in a lowermost ceramic layer 962*a* which covers an opening of the pressure chamber 924, the defect 960 extends from the surface of the pressure chamber 924 to the electrode as shown in FIG. 1, disadvantageously, ink penetrates into the lowermost ceramic layer 962*a* from the pressure chamber 924 through the defect 960, causing electrical short circuit between the electrodes.

Thus, in Japanese Patent Application Laid-Open No. 2002-59547, an ink impermeable adhesive sheet is used to adhere a cavity unit 920 to the piezoelectric actuator 921 and the adhesive sheet covers the whole surface of the piezoelectric actuator 921 opposed to the cavity unit 920. Thus, the ceramic layers 962 of the piezoelectric actuator 921 do not directly contact ink.

SUMMARY

In the cavity unit 920, electric charges may accumulate in ink due to static electricity and the like. Generally, ink is positively charged and a potential difference between an ink 970 filled into the pressure chamber 924 and the grounded common electrode 953 of the piezoelectric actuator 921 occurs across the lowermost ceramic layer 962*a*. Since such potential difference generates electroendosmosis which moves the positively charged ink 970 toward the cathode (common electrode 953), a positive force of penetrating into the ceramic layer 962 is applied to the ink.

In the above-mentioned Japanese Patent Application Laid-Open No. 2002-59547, although the adhesive sheet covers the ceramic layer 962 of the piezoelectric actuator 921, microscopically, a lot of minute holes exist in the adhesive sheet. Thus, when the above-mentioned force of positively guiding the ink toward the ceramic layer is applied, the ink passes through the adhesive sheet. As a result, when the defect 960 as shown in FIG. 1 exists in the ceramic layer 962, the ink penetrates into the defect, causing electrical short circuit as conventional.

In addition, the defect in the ceramic layer 962 occurs at a step of sintering the ceramic layer 962 as well as a step of adhering the piezoelectric actuator 921 to the cavity unit 920 and a step of stacking the other member such as a flexible wiring substrate on the piezoelectric actuator 921 due to a force of pressing the piezoelectric actuator 921 toward the cavity unit 920. For this reason, it is difficult to visually confirm the defect 960 existing in the ceramic layer 962 in an assembled state.

To solve the above-mentioned problem, an object is to provide a liquid discharge apparatus and a check method of the apparatus which can detect the existence of the defect (crack) in the ceramic layer covering the opening of the pressure chamber with high accuracy.

To achieve the above-mentioned object, the liquid discharge apparatus according to a first aspect is a liquid discharge apparatus, comprising: a cavity unit including a nozzle for discharging liquid and a pressure chamber which communicates with the nozzle and has an opening; and a piezoelectric actuator which includes a first ceramic layer covering the opening of the pressure chamber, second and third ceramic layers sequentially stacked on the side opposite to the side on which the first ceramic layer covers the opening, a first electrode disposed between the first ceramic layer and the second ceramic layer, a second electrode disposed between the second ceramic layer and the third ceramic layer and a third electrode sandwiching the third ceramic layer with the second electrode, and said piezoelectric actuator being fixed to the cavity unit, wherein the piezoelectric actuator is displaced by applying voltage between the first electrode and the second electrode and between the second electrode and the third electrode, thereby applying discharge pressure to liquid filled in the pressure chamber, the first electrode and the third electrode are connected to at least two terminals which are provided on the piezoelectric actuator, and independent of each other on the piezoelectric actuator electrically, respectively.

A check method of the liquid discharge apparatus according to a second aspect is a check method of a liquid discharge apparatus comprising a cavity unit including a nozzle for discharging liquid and a pressure chamber which communicates with the nozzle and has an opening; and a piezoelectric actuator which includes a first ceramic layer covering the opening of the pressure chamber, second and third ceramic layers sequentially stacked on the side opposite to the side on which the first ceramic layer covers the opening, a first electrode disposed between the first ceramic layer and the second ceramic layer, a second electrode disposed between the second ceramic layer and the third ceramic layer and a third electrode sandwiching the third ceramic layer with the second electrode, and said piezoelectric actuator being fixed to the cavity unit, wherein the piezoelectric actuator is displaced by applying voltage between the first electrode and the second electrode and between the second electrode and the third electrode, thereby applying discharge pressure to liquid filled in the pressure chamber, comprising the steps of: connecting the first electrode and the third electrode to at least two terminals which are provided on the piezoelectric actuator, and independent of each other on the piezoelectric actuator electrically, respectively; filling liquid into the pressure chamber; and measuring an electrical characteristic between the first electrode and the cavity unit.

According to the first aspect and the second aspect, the first ceramic layer, the first electrode, the second ceramic layer, the second electrode, the piezoelectric actuator is disposed from the side of the pressure chamber. By applying voltage between the first electrode and the second electrode and between the second electrode and the third electrode, the second ceramic layer and the third ceramic layer are displaced, thereby applying discharge pressure to liquid filled in the pressure chamber. With such configuration, the existence of a defect in the first ceramic layer can be detected by using the first electrode. That is, the electrical characteristic between the first electrode and the cavity unit changes due to penetration of liquid into the defect developed in the first ceramic layer. Thus, in the state where the first electrode and the third electrode are connected to at least two terminals which are provided on the piezoelectric actuator, and independent of each other on the piezoelectric actuator electrically, respectively, the existence of the defect in the first ceramic layer can be detected by filling liquid into the pressure chamber and measuring the electrical characteristic between the first electrode and the cavity unit.

The above and further objects and features will more fully be apparent from the following detailed description with accompanying drawings.

DETAILED DESCRIPTION

Figure 1:
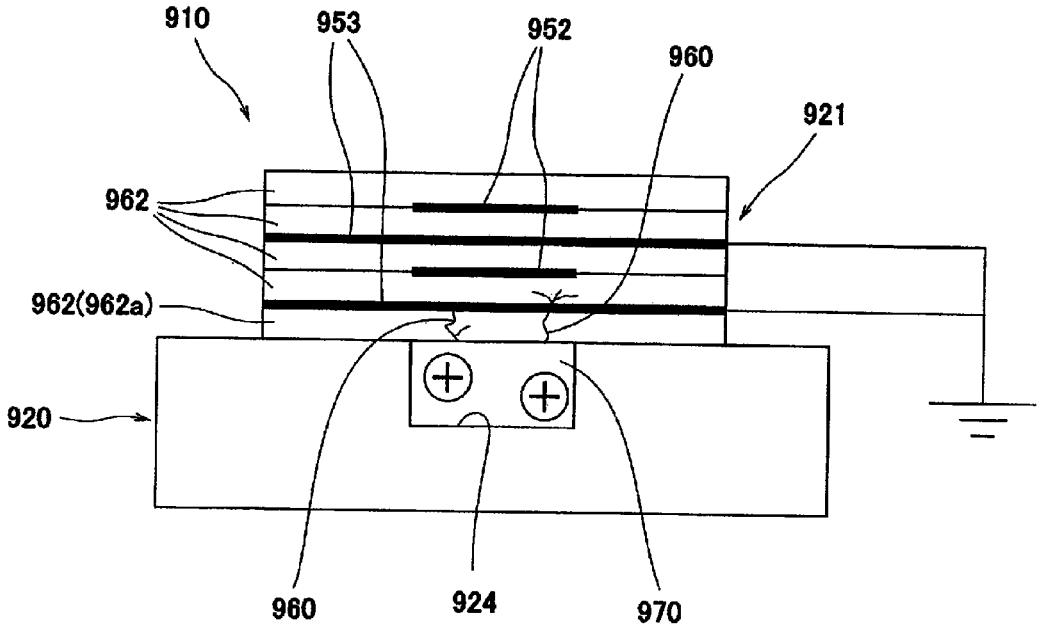
FIG. 1 is a vertical sectional view showing a conventional ink jet head.
Figure 2:
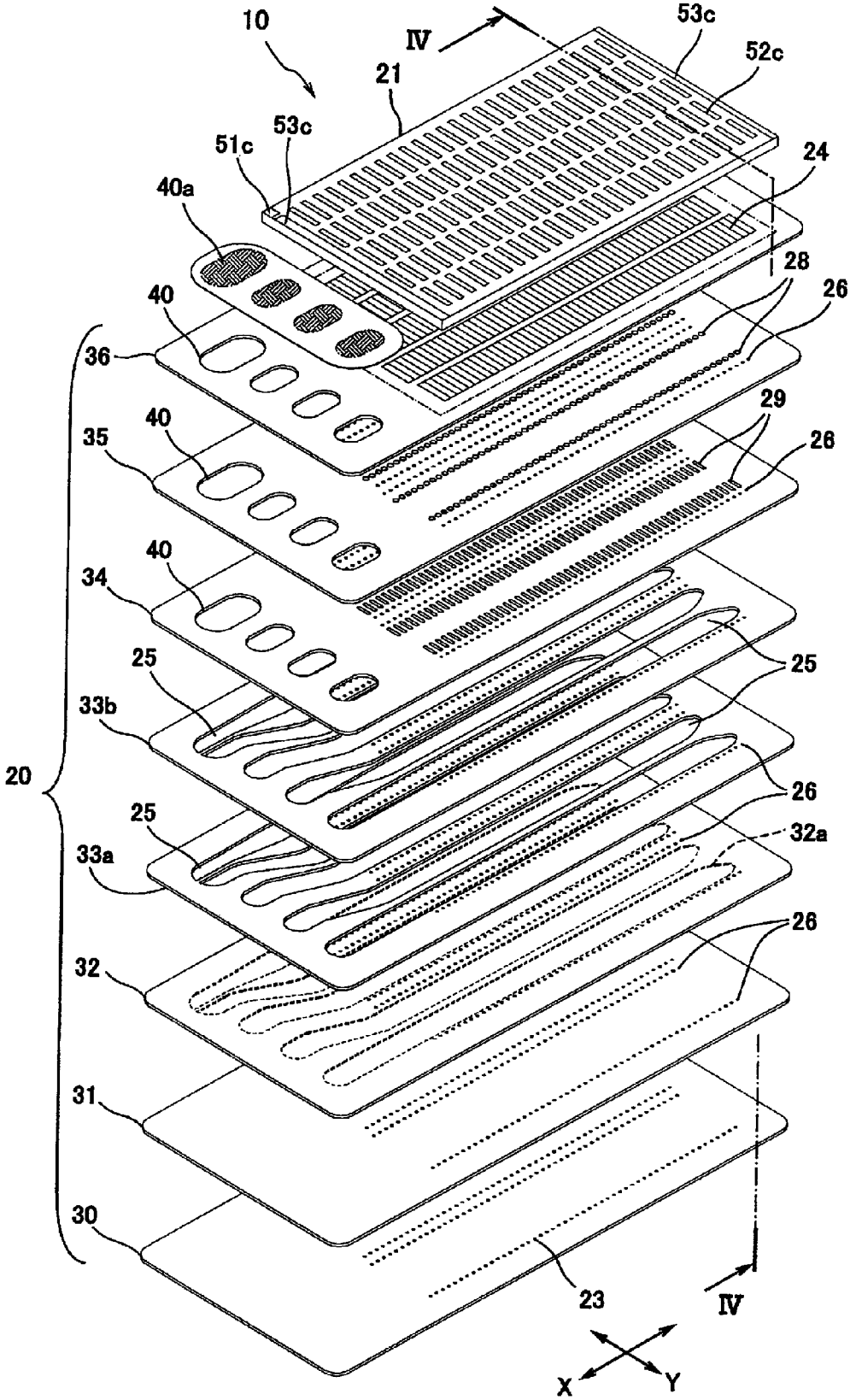
FIG. 2 is an exploded perspective view of a cavity unit and a piezoelectric actuator in an ink jet head according to a first embodiment.

An ink jet head embodied as a liquid discharge apparatus in this embodiment will be described below with reference to the drawings. Terms "upper" and "lower" in the following description means relative position in the drawings. First, with reference to FIGS. 2 to 8, an ink jet head 10 according to a first embodiment will be described. As shown in FIG. 2, the ink jet head 10 has a cavity unit 20 made of a plurality of plates, a piezoelectric actuator 21 joined to an upper surface of the cavity unit and a flexible wiring substrate 22 (FIG. 3) joined to an upper surface of the piezoelectric actuator 21.

The cavity unit 20 is formed by stacking a nozzle plate 30, a spacer plate 31, a damper plate 32, two manifold plates 33*a*, 33*b*, a supply plate 34, a base plate 35 and a cavity plate 36 which are thin plates and integrating them into one unit by use of an adhesive. Each of the plates 30 to 36 has the thickness of about 50 to 150 μm. The nozzle plate 30 is made of synthetic resin such as polyimide and the other plates 31 to 36 are made of 42% nickel alloy steel plate. A number of ink discharge nozzles 23 each having a minute diameter (about 20 μm) are drilled in the nozzle plate 30 at minute intervals. The nozzles 23 are arranged in five rows in the long side direction (X direction) of the nozzle plate 30.

A plurality of pressure chambers 24 corresponding to the nozzles 23 are arranged on the cavity plate 36 in five rows. Each of the pressure chambers 24 passes through the cavity plate 36 and is shaped to be elongate when viewed in a plan view so that the longitudinal direction may be the short side direction (Y direction) of the cavity plate 36. That is, an upper surface of each pressure chamber 24 is opened, and upper and lower sides of each pressure chamber 24 are defined by covering the opening with the piezoelectric actuator 21 and a lower surface of each pressure chamber 24 with the base plate 35. One end of the pressure chamber 24 in the longitudinal direction communicates with the nozzles 23 and the other end communicates with a common ink chamber 25 described later.

Five common ink chambers 25 long in the long side direction (X direction) are formed on the two manifold plates 33*a*, 33*b* so as to pass through the plates and extend along each row of the pressure chambers 24. That is, upper and lower sides of each common ink chamber (manifold chamber) 25 are defined by stacking the two manifold plates 33*a*, 33*b* and covering upper surfaces thereof with the supply plate 34 and lower surfaces thereof with the damper plate 32.

Connection channels 29 and through holes 28 for supplying ink from the common ink chambers 25 to the pressure chambers 24 are provided on the base plate 35 and the supply plate 34, respectively, which are located between the cavity plate 36 and the manifold plate 33*b*. Each of connection channels 29 on the supply plate 34 has a narrowed part having a small cross-sectional area so as to have a large channel resistance and is connected to one end of each pressure chamber 24 through the through hole 28 on the base plate 35.

Four ink supply ports 40 are drilled in an end of one of short sides of each the cavity plate 36, base plate 35 and supply plate 34 at corresponding positions. These ink supply ports 40 communicate with one ends of common ink chambers 25 respectively and ink is supplied from an ink source to the common ink chambers 25 through the ink supply ports 40. To supply frequently-used ink, for example, black ink, one ink supply port 40 is larger than the remaining ink supply ports 40. A filter 40*a* is adhered to each ink supply port 40 by use of an adhesive or the like.

The damper plate 32 has thinned parts 32*a* at positions corresponding to the common ink chambers 25. When discharge pressure is applied to ink in the pressure chambers 24, the pressure transmitted to the common ink chambers 25 is absorbed due to elastic deformation of the thinned parts 32*a*.

Front ends of the pressure chambers 24 communicate with the nozzles 23 on the nozzle plate 30 through communicating holes 26 drilled in the base plate 35, the supply plate 34, the two manifold plates 33*a*, 33*b*, the damper plate 32 and the spacer plate 31.

Ink is supplied from the ink supply ports 40 to the common ink chambers 25 and then, distributed into the pressure chambers 24 through the connection channels 29 on the supply plate 34 and the through holes 28 on the base plate 35. Then, the ink reaches the nozzles 23 corresponding to the pressure chambers 24 from the pressure chambers 24 through the communicating holes 26.

The piezoelectric actuator 21 is shaped like a flat plate over the plurality of pressure chamber 24 and has a plurality of ceramic layers stacked in the same direction as the stacking direction of the plurality of plates 30 to 36 and a plurality of electrodes disposed in the direction perpendicular to the stacking direction of the plurality of ceramic layers. A mix containing ceramic particles, binder and solvent is shaped to a thin plate having a thickness of about 30 μm to form a green sheet. Electrodes are appropriately patterned on an upper surface of the green sheet using conductive paste. The piezoelectric actuator 21 is formed by stacking the plurality of green sheets and integrating them by means of sintering. Thus, each green sheet becomes a ceramic layer of sintered body. The ceramic layers thus formed include a lowermost first ceramic layer 41 which directly covers openings of the pressure chambers (on the side of the cavity unit 20), a second ceramic layer 42 stacked on an upper surface of the first ceramic layer 41, a third ceramic layer 43 stacked on an upper surface of the second ceramic layer 42, an uppermost fourth ceramic layer 44 (insulating film) and a fifth ceramic layer 45 located immediately below the uppermost fourth ceramic layer 44. The plurality of second and third ceramic layers 42, 43 are alternately stacked.

The electrodes include a first electrode 51 disposed between the first ceramic layer 41 and the second ceramic layer 42, a second electrode 52 disposed between the second ceramic layer 42 and the third ceramic layer 43 and a third electrode 53 disposed between the third ceramic layer 43 and the second ceramic layer 42 above the upper surface of the third ceramic layer 43 (sandwiching the third ceramic layer 43 with the second electrode 52).

In this embodiment, the material of the fourth and fifth ceramics layers 44, 45 may not be different from that of the first, second and third ceramics layers 41, 42, 43. For example, the material thereof may be a film made of polyimide or the like, or insulating material such as insulating resin coat.

Figure 3:
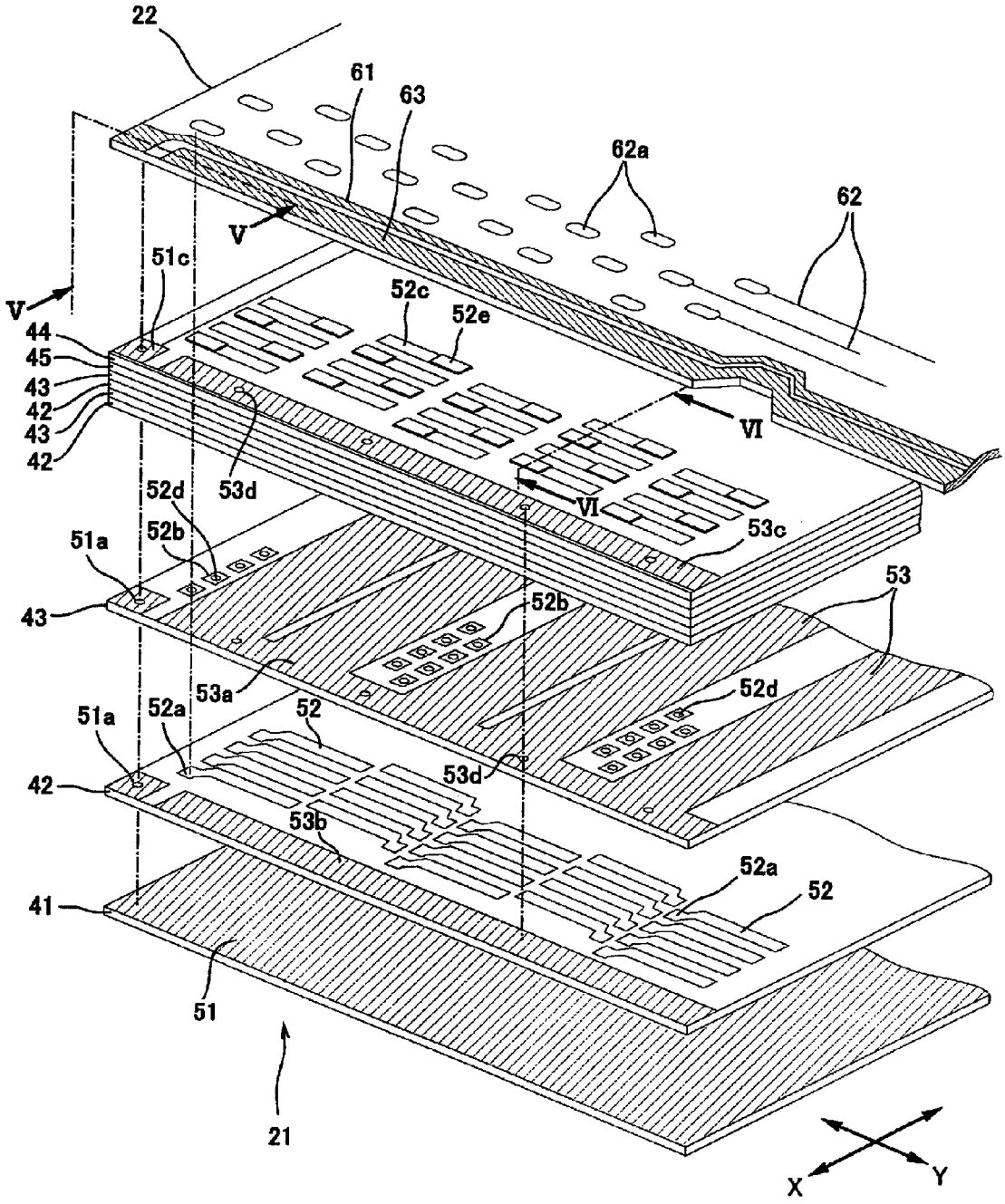
FIG. 3 is an exploded perspective view of the piezoelectric actuator and a wiring substrate in the ink jet head according to the first embodiment.
Figure 4:
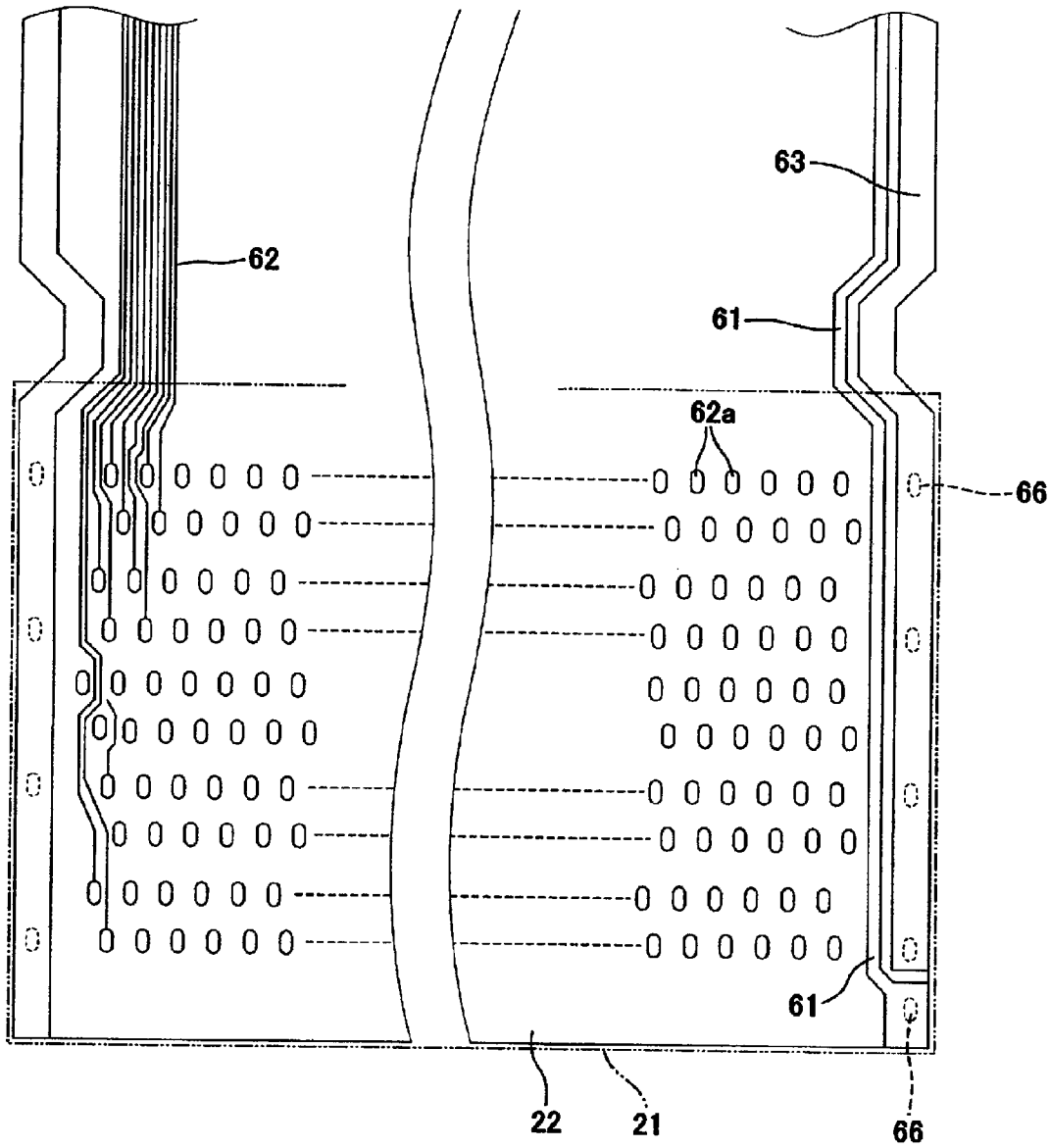
FIG. 4 is a plan view of the wiring substrate in the ink jet head according to the first embodiment.
Figure 5:
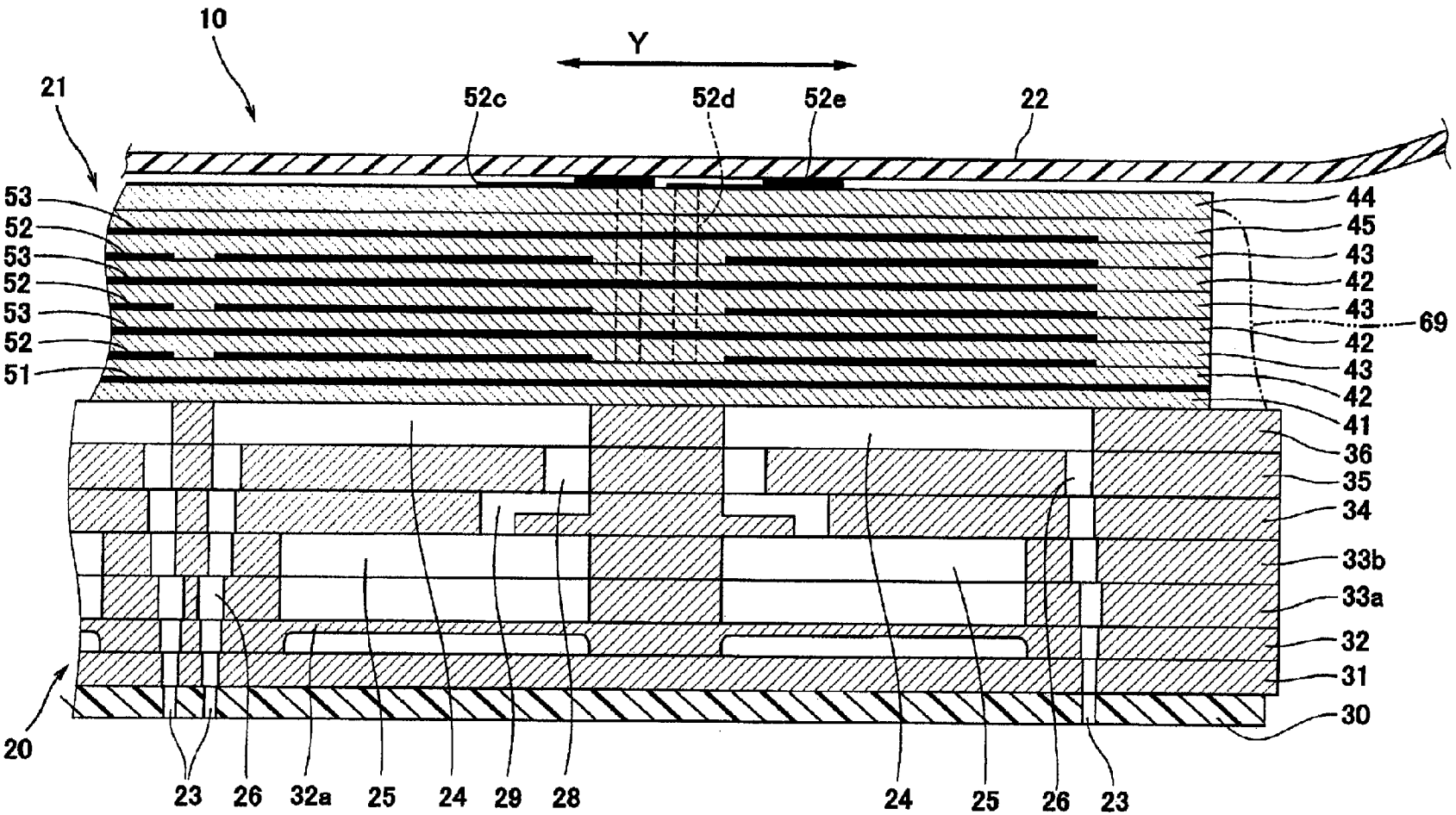
FIG. 5 is a sectional view of the ink jet head taken along a line IV-IV in FIG. 2.
Figure 6:
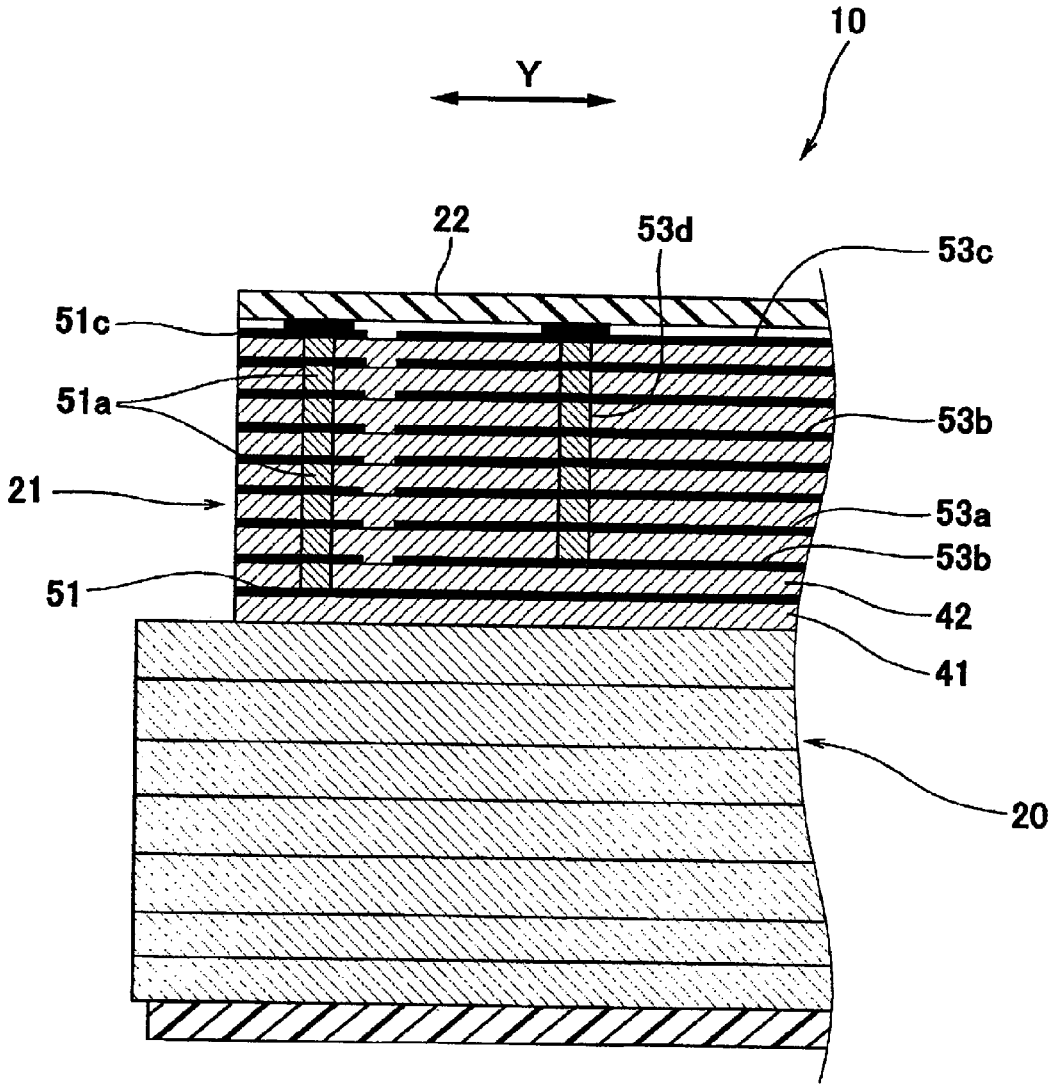
FIG. 6 is a sectional view of the ink jet head taken along a line V-V in FIG. 3.
Figure 7:
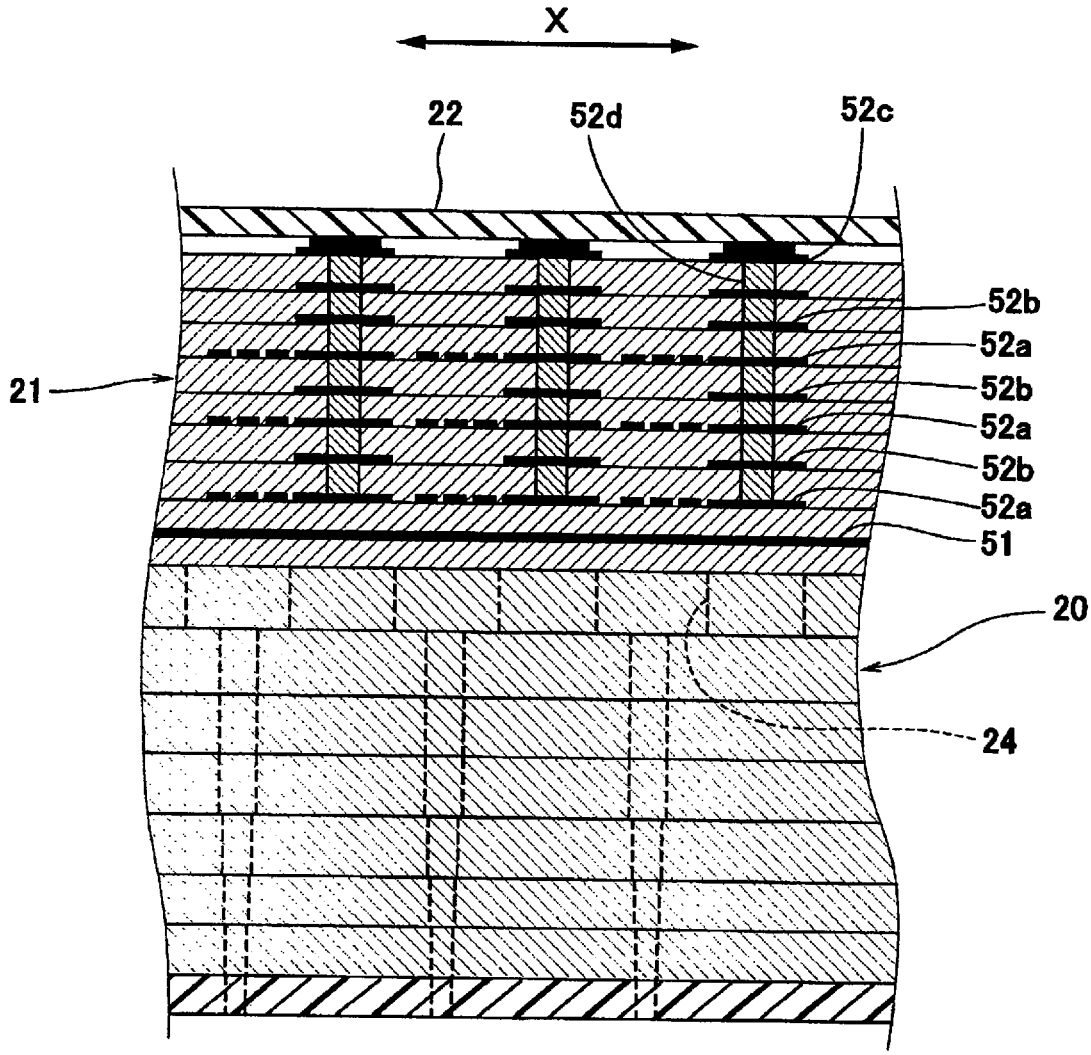
FIG. 7 is a sectional view of the ink jet head taken along a line VI-VI in FIG. 3.

In FIG. 3, the first electrode 51 is provided over the upper surface of the first ceramic layer 41. However, the first electrode 51 only needs to be formed corresponding to all of the pressure chambers 24 so as to communicate with each other.

The second electrodes 52 are provided on the second ceramic layer 42 and correspond to the respective pressure chambers 24. The third electrode 53 is formed corresponding to all of the pressure chambers 24 so as to communicate with each other. The third electrode 53 may be formed over the upper surface of the third ceramic layer 43. In this embodiment, as described later, the third electrode 53 is formed on the third ceramic layer 43 to be shaped like a band for each row of pressure chamber 24 while keeping a region for conductive materials 52*b* for connecting the second electrodes 52 to second terminals 52*c* provided on the fourth ceramic layer 44. The plurality of second ceramic layers 42 having the second electrodes 52 and the plurality of third ceramic layers 43 having the third electrode 53 are alternately stacked.

That is, the second ceramic layer 42 is sandwiched between the first electrode 51 and the second electrodes 52, the third ceramic layer 43 is sandwiched between the second electrodes 52 and the third electrode 53 and the second ceramic layer 42 above the third ceramic layer 43 is sandwiched between the third electrode 53 and the second electrodes 52. By connecting the first and third electrodes 51, 53 to a common low voltage area and connecting the second electrodes 52 to a high voltage area, regions of the ceramic layers sandwiched by each electrode are polarized symmetrically with respect to the second electrodes 52 (the direction from the second electrodes 52 toward the first electrode 51 and the direction from the second electrodes 52 toward the third electrode 53) to form activated parts. For discharge of ink, the first and third electrodes 51, 53 are connected to a common low voltage area (for, example, grounded) and the second electrodes 52 are connected to a high voltage area. That is, when voltage in the polarizing direction is applied, the activated parts extend in the stacking direction.

No electrode is provided between the fourth ceramic layer 44 and the fifth ceramic layer 45. This prevents displacement of the above-mentioned activated parts from appearing on the side of the upper surface of the piezoelectric actuator 21 and allows the displacement to remarkably appear on the side of the pressure chambers 24. First, second and third terminals connected to the first, second and third electrodes 51, 52, 53, respectively, are provided on the upper surface of the fourth ceramic layer 44 on the opposite side to the pressure chambers 24.

A first terminal 51*c* is electrically connected to the first electrode 51 through the conductive materials 51*a* filled in through holes provided in the ceramic layers 42, 43, 44, 45 in the stacking direction.

The third electrode 53 has band-like conductive material 53*a* connecting both ends of each band-like parts along the row of the pressure chambers 24 to each other (only one end is shown in FIG. 3). Conductive materials 53*b* are provided on the ceramic layers 42, 44, 45 at positions corresponding to the conductive material 53*a* in the stacking direction. A conductive material on the fourth ceramic layer 44 forms a third terminal 53*c*. A through hole is provided on each of the ceramic layers 42, 43, 44, 45 in the stacking direction by passing through the region where the conductive material 53*a*, 53*b* or the third terminal 53*c* is provided. A conductive material 53*d* is filled in the through hole. The conductive material 53*d* electrically connects the band-like conductive materials 53*a*, 53*b* and the third terminal 53*c* to one another. Thus, the third terminal 53*c* is electrically connected to all the third electrodes 53.

The conductive materials 53*a*, 53*b* and the third terminal 53*c* are each shaped like a band along both side edges of each ceramic layer 42, 43, 44, 45 in parallel with the pulling direction of the wiring substrate 22 described later. The first terminal 51*c* and the conductive material 51*a* which are connected to the first electrode 51 are shaped like an island at corners of the ceramic layers 42, 43, 44, 45 on the extension of the conductive materials 53*a*, 53*b* and the third terminal 53*c* in the longitudinal direction. The first terminal 51*c* and the third terminal 53*c* are independent of each other on the piezoelectric actuator electrically, at least when forming a pattern. The first terminal 51*c* is separated from the third terminal 53*c*.

Each second electrode 52 has an extension conductive material 52*a* to be connected to the second terminal 52*c* on the fourth ceramic layer 44 at one end thereof. The extension conductive material 52*a* deviates from the extension of the second electrode 52 in the longitudinal direction so as to be located at a partition between the pressure chambers 24. Conductive materials 52*b* are formed on the third ceramic layer 43 and the fifth ceramic layer 45 at positions corresponding to the extension conductive materials 52*a* in the vertical direction. A conductive material 52*d* is filled in through holes passing through regions where the conductive materials 52*b* are provided on the third and fifth ceramic layers 43, 45 in the stacking direction. The extension conductive materials 52*a* on the second ceramic layer 42, the conductive materials 52*b* on the third ceramic layer 43 and the fifth ceramic layer 45 and the second terminals 52*c* on the fourth ceramic layer 44 are electrically connected to one another through the conductive materials 52*d*. Thus, each second terminal 52*c* is electrically connected to all the second electrodes 52 in the stacking direction.

No through hole is provided on the regions of the conductive material 53*b* and the extension conductive materials 52*a* on the second ceramic layer 42 adjacent to the first electrode 51 so that the third electrodes 53 and the second electrodes 52 are electrically independent of the first electrode 51.

The second terminal 52*c* connected to the second electrode 52 has a predetermined length in the direction perpendicular to the row of the pressure chambers 24 and has a connection terminal part 52*e* to be connected to the wiring substrate 22 described later at one end thereof in the length direction. Each connection terminal part 52*e* is located at one end of the each second terminal 52*c* and adjacent connection terminal parts 52*e* are located at the opposite ends of the second terminals 52*c*. Thus, a distance between adjacent connection terminal parts 52*e* is large. Although FIG. 3 does not show connection terminal parts such as the connection terminal parts 52*e* on the first terminal 51*c* and the third terminal 53*c*, the connection terminal parts may be protrudingly provided on the terminals.

Figure 8:
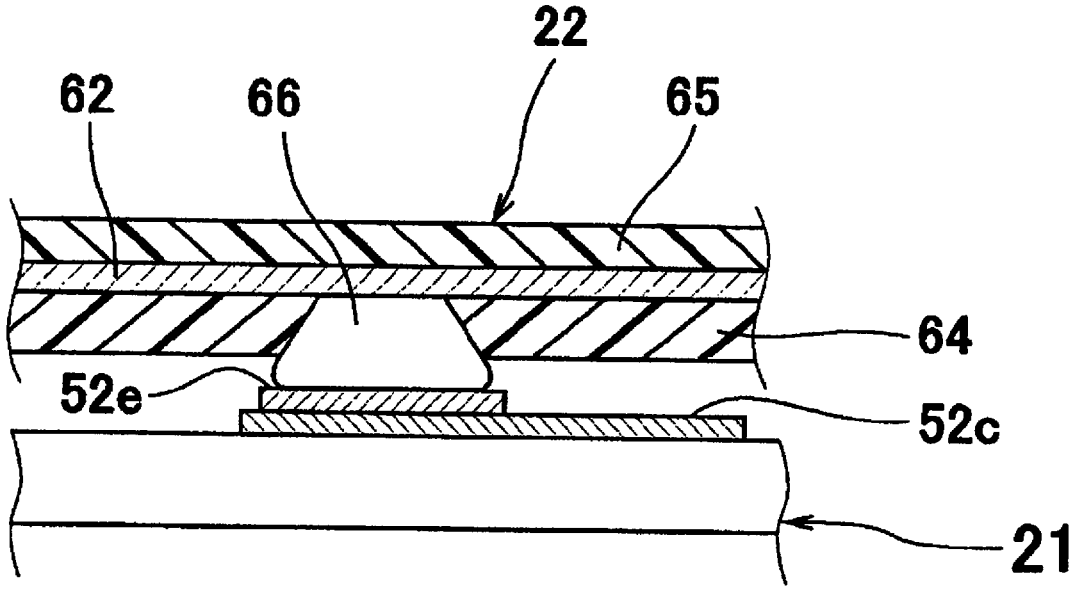
FIG. 8 is a sectional view showing a connection between the wiring substrate and the piezoelectric actuator in the ink jet head according to the first embodiment.

The flexible wiring substrate 22, as shown in FIG. 8, has structure in which wiring is formed on an insulating film 64 made of polyimide or the like and the wiring is covered with an insulator 65. A second wiring 62 is connected to the second terminal 52*c* by allowing a connection terminal 62*a* as an end of the second wiring 62 to be exposed from an opening of the insulating film 64, providing a bump of a conductive brazing material 66 on the connection terminal 62*a* and welding the brazing material 66 to the second terminal 52*c*. Similarly, a first wiring 61 connected to the first terminal 51*c* and a third wiring 63 connected to the third terminal 53*c* are exposed from openings of the insulating film 64 at positions corresponding to the first and third terminals 51*c*, 53*c* and connected to the first and third terminals 51*c*, 53*c* through conductive brazing material, respectively.

The wiring substrate 22 is pulled out from the upper surface of the piezoelectric actuator 21 in the direction perpendicular to the long side direction of the piezoelectric actuator (X direction) and connected to a driving circuit (not shown). The first and third wirings 61, 63 extend in parallel along both side edges of the wiring substrate 22 in the direction of pulling the wiring substrate 22. When ink is discharged, the first and third wirings 61, 63 are grounded, that is, connected to a ground potential, and positive voltage is selectively applied to the second electrode 52 through the second wiring 62. Since the number of third electrodes 53 is larger than that of the first electrodes 51, to bring impedance into balance, the third wiring 63 has a smaller electrical resistance value than the first wiring 61, for example, has a larger width when viewed in a plan view than the first wiring 61.

Here, a manufacturing process of the ink jet head 10 will be briefly described. The cavity unit 20, the piezoelectric actuator 21 and the wiring substrate 22 are previously configured as described above (first step). Next, the piezoelectric actuator 21 is adhered to the upper surface of the cavity unit 20 under pressure (second step). Next, the wiring substrate 22 provided with the brazing material 66 is disposed on the upper surface of the piezoelectric actuator 21 and the bump of the brazing material 66 is heated and welded to the first, second and third terminals 51*c*, 52*c*, 53*c* while pressing the wiring substrate 22 (third step). Thus, the wiring substrate 22 is fixed to the piezoelectric actuator 21 and the first, second and third terminals 51*c*, 52*c*, 53*c* are electrically connected to the corresponding first, second and third wiring 61, 62, 63. Next, a conductive member 69 made of conductive paste is adhered to the side face of the piezoelectric actuator 21 over the third electrode 53 and the cavity unit 20 (fourth step). In this embodiment, the conductive member 69 is provided on the regions of the side face of the piezoelectric actuator 21 where the first electrode 51 and the third electrode 53 are exposed. The first electrode 51, the third electrode 53 and the cavity unit 20 are electrically connected to one another via the conductive member 69. This prevents voltage applied to the second electrodes 52 from leaking thereby making ink discharge in the other pressure chambers unstable or charging ink with static electricity as described in Japanese Patent Application Laid-Open No. 2003-80709.

Before or after the fourth step, the wiring substrate 22 is connected to an external substrate (not shown) coupled to a power source or the like (fifth step). A plurality of connection terminals connected to the first, second and third wirings 61, 62, 63 (connected to the second wiring 62 through a driving circuit) are arranged along one edge of the wiring substrate 22. A receptacle connector engaged with the connection terminal of the wiring substrate 22 is installed on the external substrate. By engaging the wiring substrate 22 (connection terminal) with the receptacle connector, the wiring substrate 22 is electrically connected to the external substrate and the first, second and third wirings 61, 62, 63 on the wiring substrate 22 are connected to external wiring printed on the external substrate. Electric power or a control signal is supplied to the driving circuit through the external substrate, thereby enabling application of voltage to the second electrodes 52.

Whether a defect (crack) occurs in the first ceramic layer 41 or not is checked as follows. Ink is filled into an ink flow path in the ink jet head including the pressure chamber 24 and an electrical characteristic such as a resistance value between the first electrode 51 and the cavity unit 20 is measured. Specifically, since the plates 31 to 36 of the cavity unit 20 are electrically conductive, an insulation resistance meter is connected to one of the plates and a member electrically connected to the first electrode 51 to measure a insulation resistance value. Ink can be filled into the cavity unit 20 (pressure chamber) at any time after completion of the second step.

When a defect (crack) extending from the pressure chamber 24 in the stacking direction occurs in the first ceramic layer 41, ink in the pressure chamber 24 penetrates in the defect. Since the first electrode 51 is electrically independent of the cavity unit 20, without the above-mentioned defect, the first electrode 51 is connected to the cavity unit 20 only through capacitance of the first ceramic layer 41 and a resistance value becomes infinite. However, when the ink penetrates into the defect, the resistance value is remarkably lowered. Accordingly, by measuring the resistance value, whether a defect exists in the first ceramic layer 41 or not can be checked.

The ink jet head with the first ceramic layer 41 determined to have a defect according to the above-mentioned check is eliminated from the manufacturing process as a defective product. Thus, since the ink jet head 10 having the piezoelectric actuator 21 without defect (crack) which leads to electrical short circuit can be selected as a non-defective product and connected to a main unit of an ink jet printer or the like, the manufacturing process can be made more efficient. As an electrical characteristic, in addition to a resistance value, capacitance between the first electrode 51 and the cavity unit 20 may be measured as necessary.

The above-mentioned check can be carried out between the second step and the third step (that is, before the wiring substrate 22 is connected to the piezoelectric actuator 21) by using the first terminal 51*c* connected to the first electrode 51. For this reason, ink is filled after the second step and before the third step. In this case, when a defect occurs in the first ceramic layer 41 at the first step and the piezoelectric actuator 21 is adhered to the cavity unit 20 at the second step, the defect occurring in the first ceramic layer 41 can be detected by applying pressure. The above-mentioned check can be also carried out between the third step and the fourth step (after the piezoelectric actuator 21 is connected to the wiring substrate 22) by using the first wiring 61 on the wiring substrate 22. For this reason, ink is filled after the second step and before the fourth step. In this case, in addition to a defect occurring at the first and second steps, when the wiring substrate 22 is connected to the piezoelectric actuator 21 at the third step, the defect occurring in the first ceramic layer 41 can be detected by applying pressure.

Figure 9:
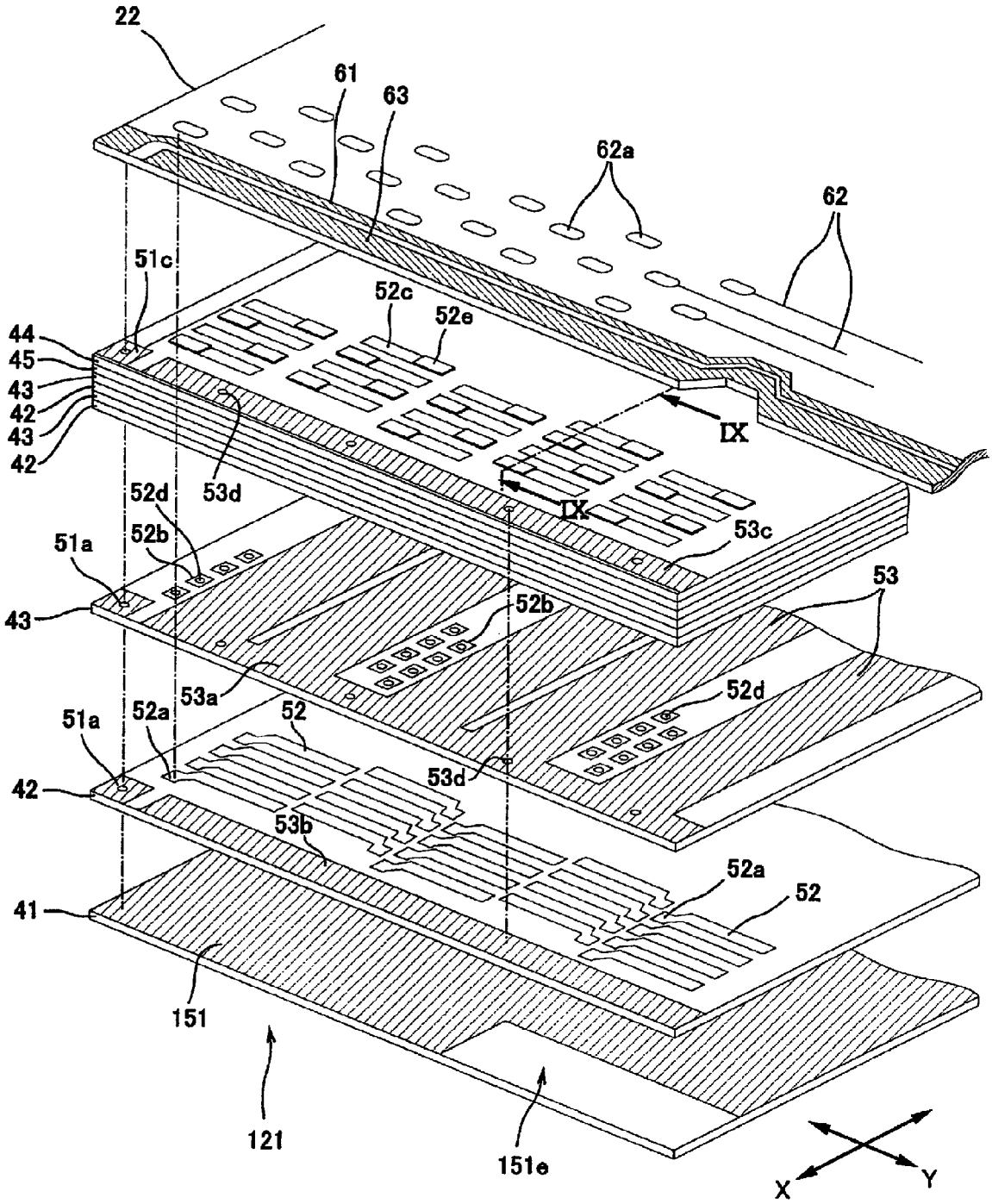
FIG. 9 is an exploded perspective view of a piezoelectric actuator and a wiring substrate in an ink jet head according to a second embodiment.
Figure 10:
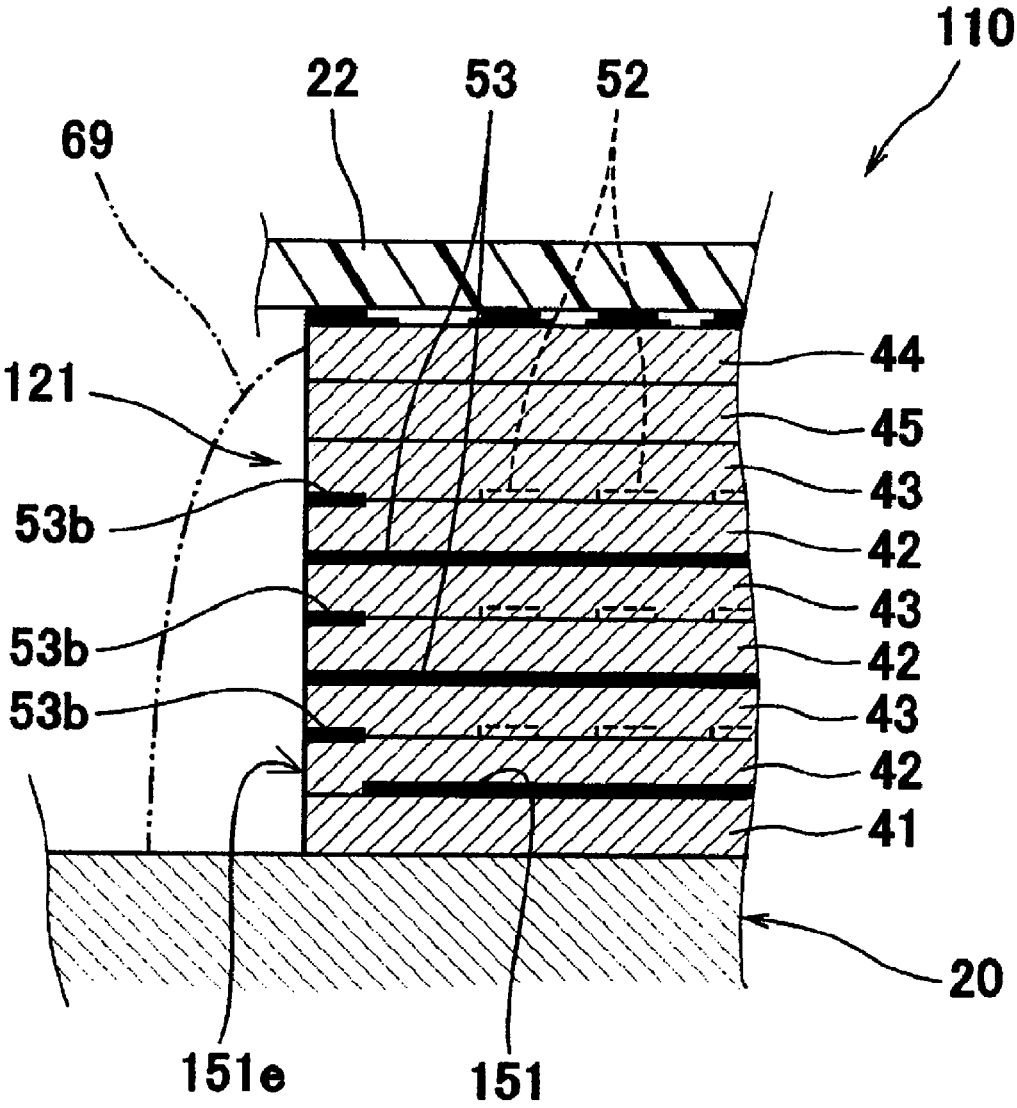
FIG. 10 is a sectional view of the ink jet head taken along a line IX-IX in FIG. 9.

Next, referring to FIGS. 9 and 10, an ink jet head 110 according to a second embodiment will be described. The ink jet head 110 is different from the ink jet head in the first embodiment, in the construction of a first electrode 151 and the check method related thereto. The same reference numerals are given to the same components and description of the components is omitted.

In the first embodiment, the first electrode 51 covers the whole upper surface of the first ceramic layer 41 and reaches each edge of the first ceramic layer 41. Thus, the first electrode 51 is exposed from four side faces of the piezoelectric actuator 21 in which the ceramic layers 41 to 45 are stacked. On the contrary, as shown in FIG. 9, the first electrode 151 in the second embodiment is not formed on the whole surface of the first ceramic layer 41 and is partially cut out. The cutout region is provided in the vicinity of an edge and the cutout region of the upper surface of the first ceramic layer 41 is exposed. Thus, when the ceramic layers 41 to 45 are stacked, as shown in FIG. 10, a part of the first electrode 151 is not exposed from the side face of the piezoelectric actuator 121. The cutout region deviates from the positions corresponding to the pressure chambers 24 and the first electrode 151 is ensured to be located below each second electrode 52 so that each activated part stably operates. Hereinafter, the unexposed region of the first electrode 151 on the side face of the piezoelectric actuator 121 is referred to as a contact prevention part 151*e*.

A manufacturing process of the ink jet head 110 having the contact prevention part 151*e* will be briefly described. As in the first embodiment, through the first to third steps, the cavity unit 20, the piezoelectric actuator 121 and the wiring substrate 22 are assembled. At the fourth step, the conductive member 69 is provided on the side face of the piezoelectric actuator 121. At this time, the conductive member 69 is provided over the exposed region of the third electrode 53 and the contact prevention part 151*e* on the side face of the piezoelectric actuator 121 and the upper surface of the cavity unit 20. Consequently, the cavity unit 20, the third electrode 53, the third terminal 53*c* and the third wiring 63 are grounded, while the first electrode 151, the first terminal 51*c* and the first wiring 61 are not electrically connected to the cavity unit 20 and the third electrode 53.

The above-mentioned check can be carried out after the fourth step by using the first wiring 61 connected to the first terminal 51*c* and the third wiring 63 connected to the third terminal 53*c*. In this case, the defect occurring through the first to fourth steps can be detected. Since the check is performed downstream of the manufacturing process, reliability of eliminating a defective product from all products is improved. When an insulation resistance value is measured, in addition to the cavity unit 20, the third wiring 63 disposed on the upper surface of the ink jet head 110 can be used, thereby improving workability and operability of check.

Further describing the manufacturing process, as in the first embodiment, at the fifth step before or after the fourth step, the wiring substrate 22 is connected to the external substrate. In the second embodiment, unlike First embodiment, the first electrode 151 is not connected to the third electrode 53 at the fourth step. Thus, a component for connecting the electrodes to each other is added. For example, following the above-mentioned check, for the conduction of the first and third wirings 61, 63, a bridge part made of a conductive material paste such as solder may be formed on the wiring substrate 22. Following the above-mentioned check and the fifth step, for the conduction of two external wirings connected to the first and third wirings 61, 63, respectively, via a connector and electrical wiring, a bridge part made of a conductive material paste such as solder may be formed on the external substrate. Connection wiring for the conduction of two external wirings connected to the first and third wirings 61, 63 is previously printed on the external substrate. In this case, when the fifth step is performed after the fourth step and the above-mentioned check, at the fifth step, the wiring substrate 22 is connected to the external substrate and the first electrode 151 is electrically connected to the third electrode 53. Accordingly, even with the above-mentioned configuration in which the first electrode 151 is not connected to the third electrode 53 via the conductive member 69, it is unnecessary to add a step of connecting the electrodes to each other, and thus, the ink jet head 110 having the above-mentioned effect in checking can be manufactured without increasing manufacturing costs.

Next, a third embodiment will be described with reference to FIGS. 11 and 12 and a fourth embodiment will be described with reference to FIGS. 13 to 15A and 15B, and a fifth embodiment will be described with reference to FIGS. 16 and 17. The third to fifth embodiments each are different from the first and second embodiments in the arrangement of terminals on the piezoelectric actuator, but are the same as the first and second embodiments in structure of the first electrode, the manufacturing process of the ink jet head and the procedure of the above-mentioned check. Hereinafter, the third to fifth embodiments will be described as variants of the first embodiment for convenience. Same reference numerals are given to the same components as those in First embodiment and description of the components is omitted.

Figure 11:
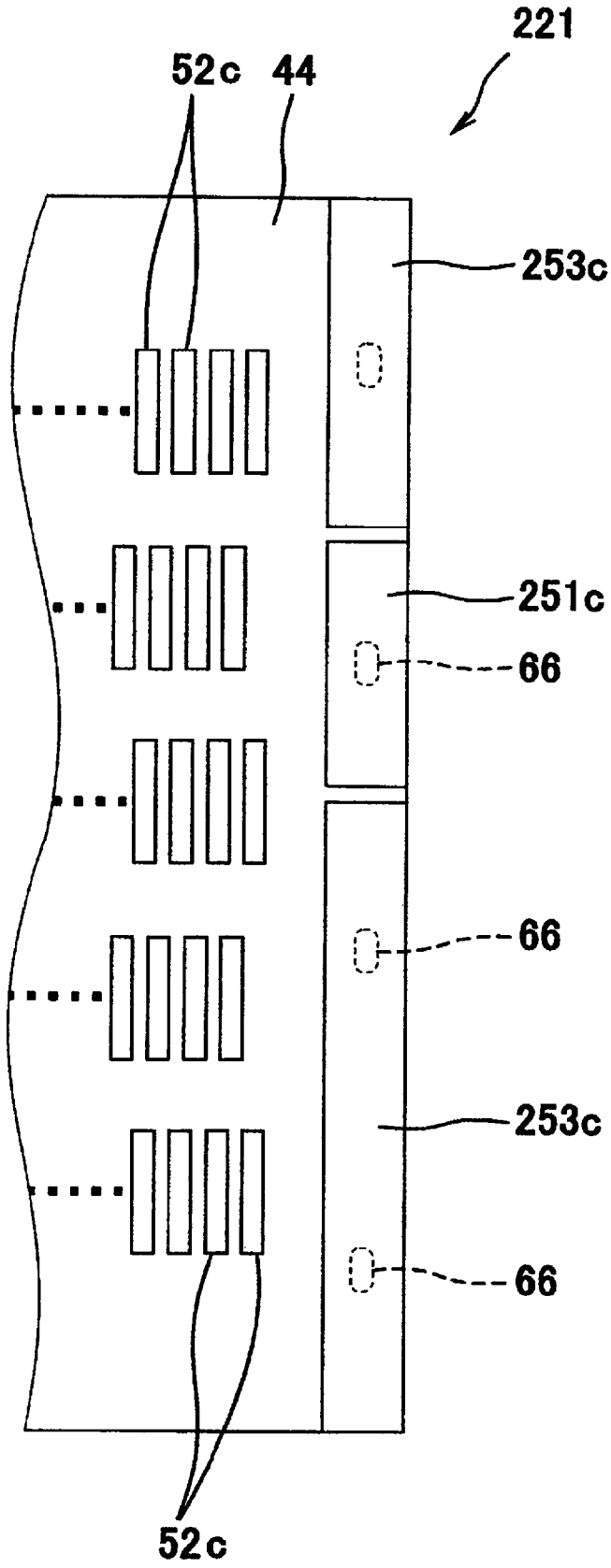
FIG. 11 is a plan view of a piezoelectric actuator in an ink jet head according to a third embodiment.
Figure 12:
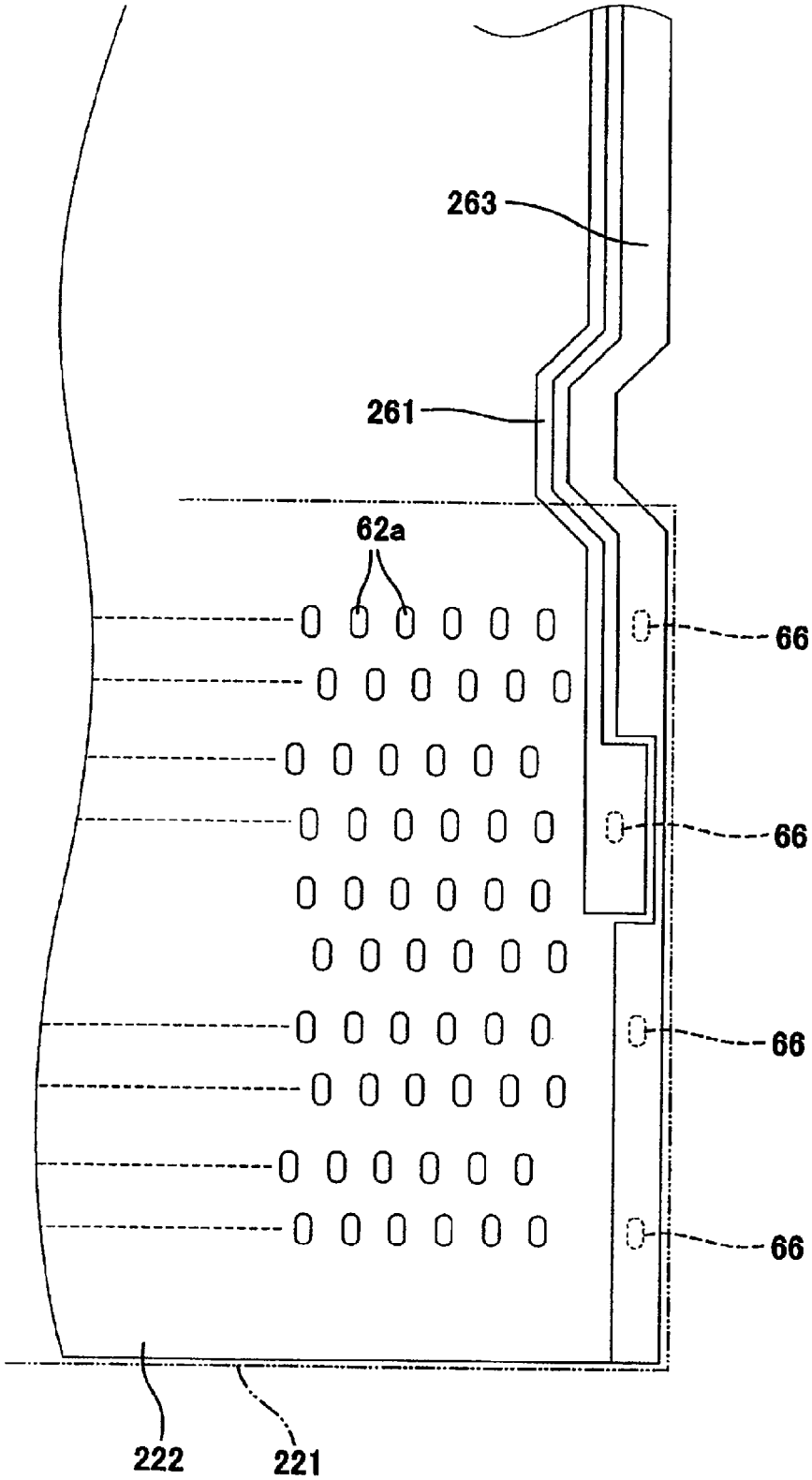
FIG. 12 is a plan view of a wiring substrate in the ink jet head according to the third embodiment.

In the third embodiment, as shown in FIG. 11, a first terminal 251*c* of the first electrode 51 and third terminals 253*c* of the third electrode 53 are provided in the vicinity of short sides of the fourth ceramic layer 44 so as to be separated from each other in the short side direction. More specifically, the first terminal 251*c* is centrally located between the two third terminals 253*c* in the short side direction. As shown in FIG. 12, corresponding to the first and third terminals 251*c*, 253*c*, first and third wirings 261, 263 connected to the first and third terminals 251*c*, 253*c* are arranged on the wiring substrate 222. By changing layout of the first and third terminals 251*c*, 253*c*, positions of through holes for connecting the terminals to the electrodes are changed as appropriate.

Even when the first and third terminals 251*c*, 253*c* are arranged in the similar manner as in the first embodiment, the region where the terminals are provided on the upper surface of the fourth ceramic layer 44 can be made compact in the long side direction. In providing three kinds of terminals on the upper surface of the piezoelectric actuator 221, the piezoelectric actuator 221 is prevented from increasing in size.

Figure 13:
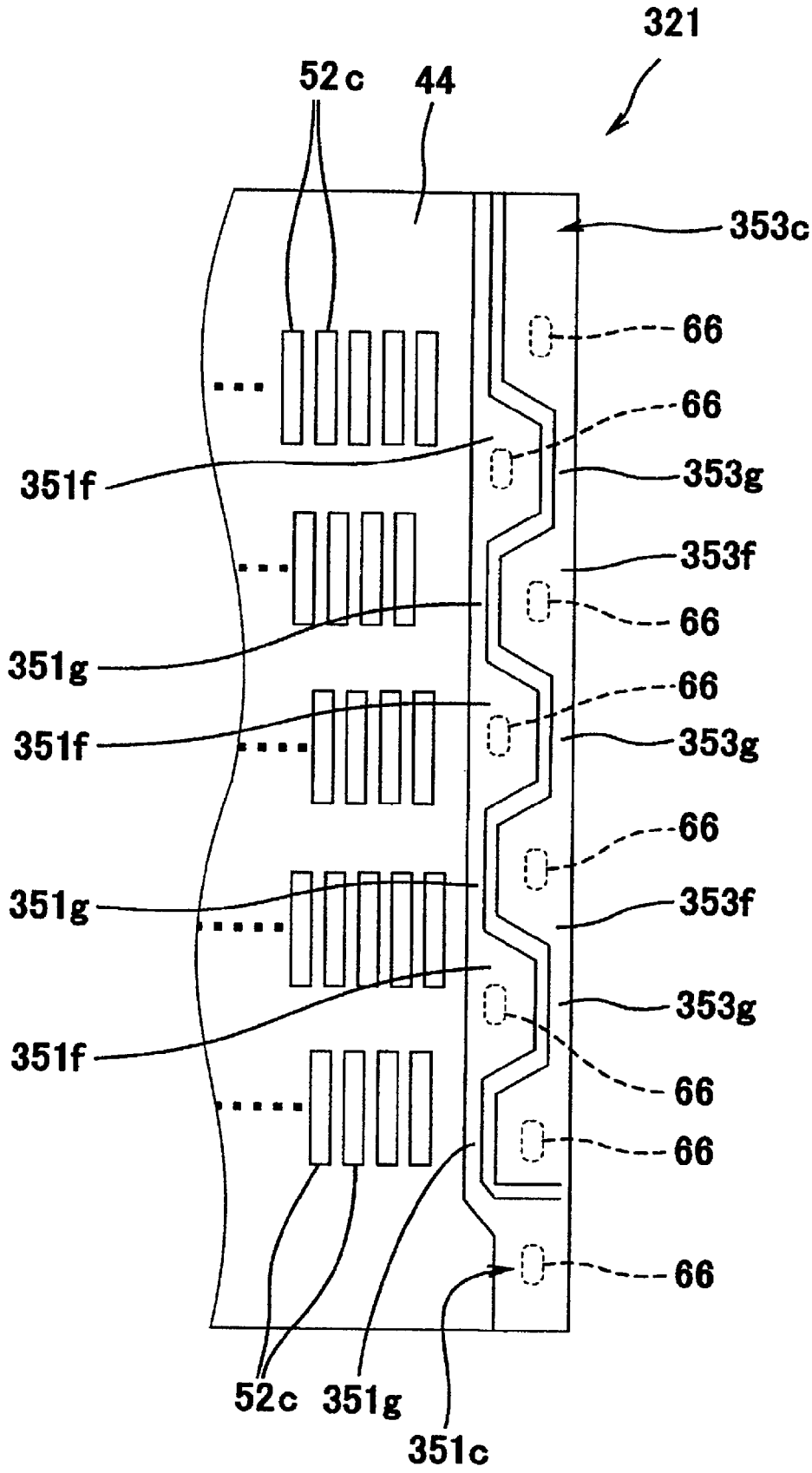
FIG. 13 is a plan view of a piezoelectric actuator in an ink jet head according to a fourth embodiment.

In the fourth embodiment, as shown in FIG. 13, a first terminal 351*c* of the first electrode 51 and the third terminal 353*c* of the third electrode 53 are provided side by side in the vicinity of short sides of the upper surface of the fourth ceramic layer 44 so as to extend in the short side direction. The first terminal 351*c* has a plurality of protruding parts 351*f*, 351*f*, . . . which are provided at substantially regular intervals in the extending direction of the first terminal 351*c* so as to protrude toward the third terminal 353*c*. The third terminal 353*c* also has a plurality of protruding parts 353*f*, 353*f*, . . . which are provided at substantially regular intervals in the extending direction of the third terminal 353*c* so as to protrude toward the first terminal 351*c*. The protruding parts 351*f*, 351*f*, . . . of the first terminal 351*c* are opposed to narrower parts 353*g* formed between adjacent protruding parts 353*f*, 353*f* of the third terminal 353*c*. Similarly, the protruding parts 353*f*, 353*f* of the third terminal 353*c* are opposed to narrower parts 351*g* formed between adjacent protruding parts 351*f*, 351*f* of the first terminal 351*c*. That is, the protruding parts 351*f*, 353*f* of the first and third terminals 351*c*, 353*c* are alternately formed in the extending direction of the first and third terminals 351*c*, 353*c*.

Figure 14:
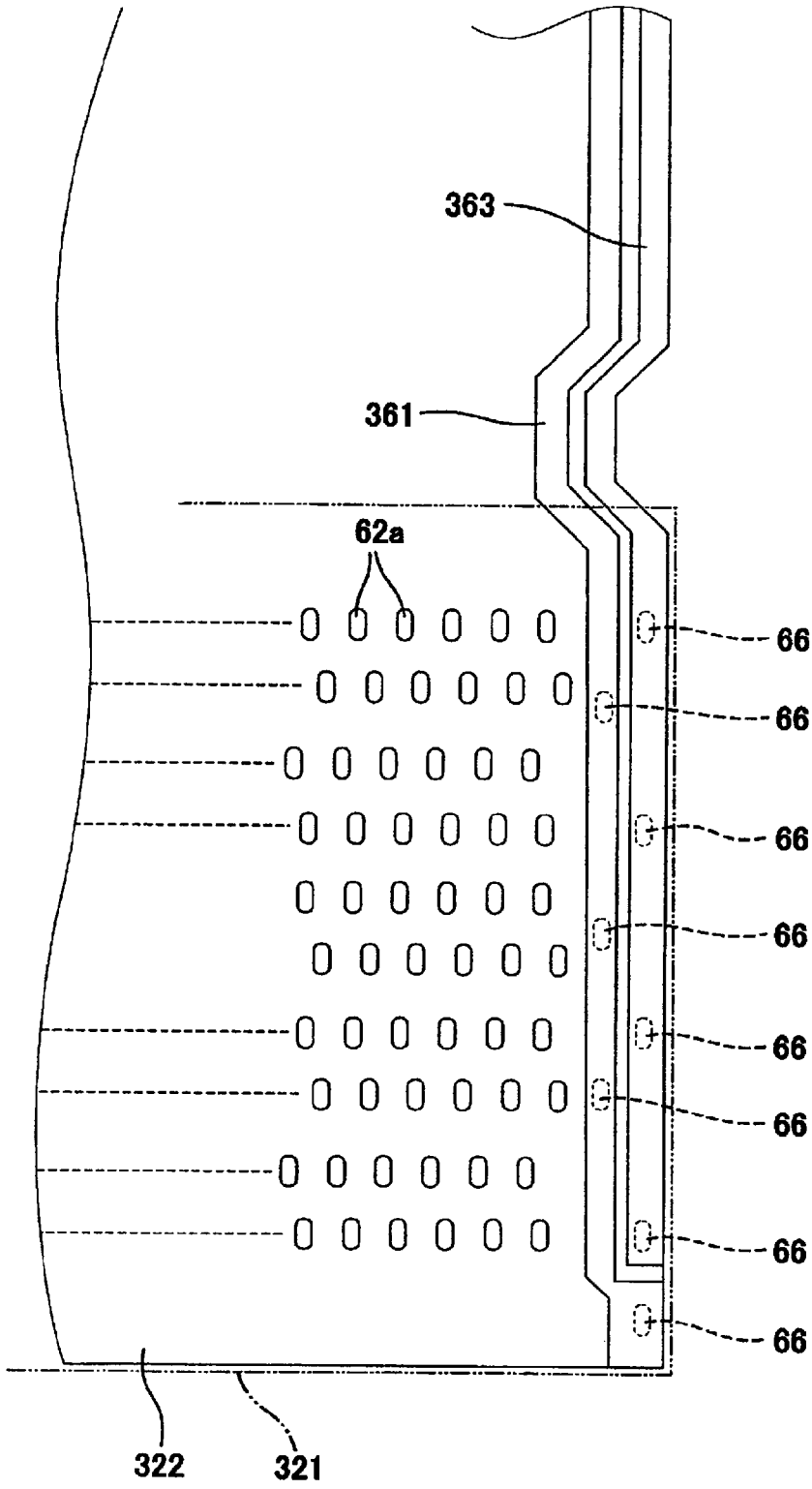
FIG. 14 is a plan view of a wiring substrate in the ink jet head according to the fourth embodiment.

As shown in FIG. 14, a first wiring 361 connected to the first terminal 351*c* and a third wiring 363 connected to the third terminal 353*c* are arranged in parallel to each other on the wiring substrate 322. An opening formed on the first wiring 361 to provide the brazing material 66 welded to the first terminal 351*c* and an opening formed on the third wiring 363 in a similar manner are alternately disposed in the extending direction of the first and third wirings 361, 363. The amount of the brazing material 66 welded to the first terminal 351*c* and the third terminal 353*c* is smaller than the amount of the brazing material 66 welded to the second terminal 52*c*.

In the ink jet head having the first and third terminals 351*c*, 353*c*, as in the first embodiment, at the third step, the brazing material 66 is welded to the protruding parts 351*f*, 353*f* of the first terminal 351*c* and the third terminal 353*c*.

As described above, regions of the first and third terminals 351*c*, 353*c*, to which the brazing material 66 is welded, are wider protruding parts 351*f*, 353*f*. The protruding part of one terminal is opposed to a narrow region between the protruding parts of the other terminal. For this reason, a sufficient area where the brazing material 66 is welded is ensured in the first and third terminals 351*c*, 353*c*. A region where the terminals are provided on the upper surface of the fourth ceramic layer 44 can be made compact in the long side direction and the piezoelectric actuator 321 is prevented from increasing in size. Furthermore, since the protruding parts to which the brazing material 66 is welded are alternately arranged as described above, there is a little possibility that the brazing materials 66 welded to the terminals are bridged to each other.

Since the amount of the brazing material 66 welded to the first terminal 351*c* of the first electrode 51 and the amount of the brazing material 66 welded to the third terminal 353*c* of the third electrode 53 are each smaller than the amount of the brazing material 66 welded to the second terminal 52*c* of the second electrode 52, the bridging of the brazing material 66 between the first and third terminals 351*c*, 353*c* which are opposed can be prevented and the state where the first electrode 51 is electrically independent of the third electrode 53 can be kept. Thus, in the defect check performed later, detection of the existence of defect can be made more reliably.

Figure 15A:
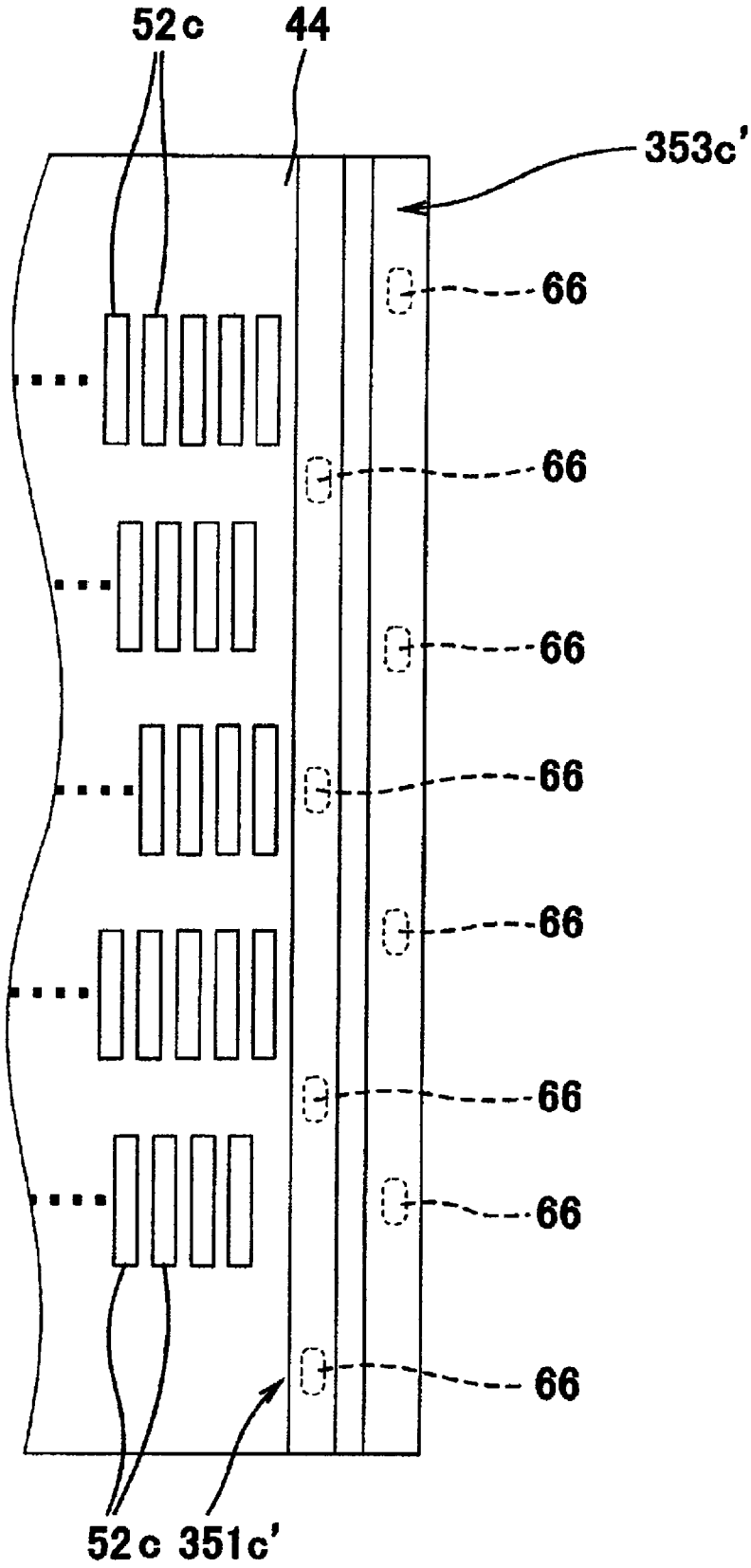
FIGS. 15A and 15B are plan views showing modified configuration examples of the piezoelectric actuator in the ink jet head according to the fourth embodiment.
Figure 15B:
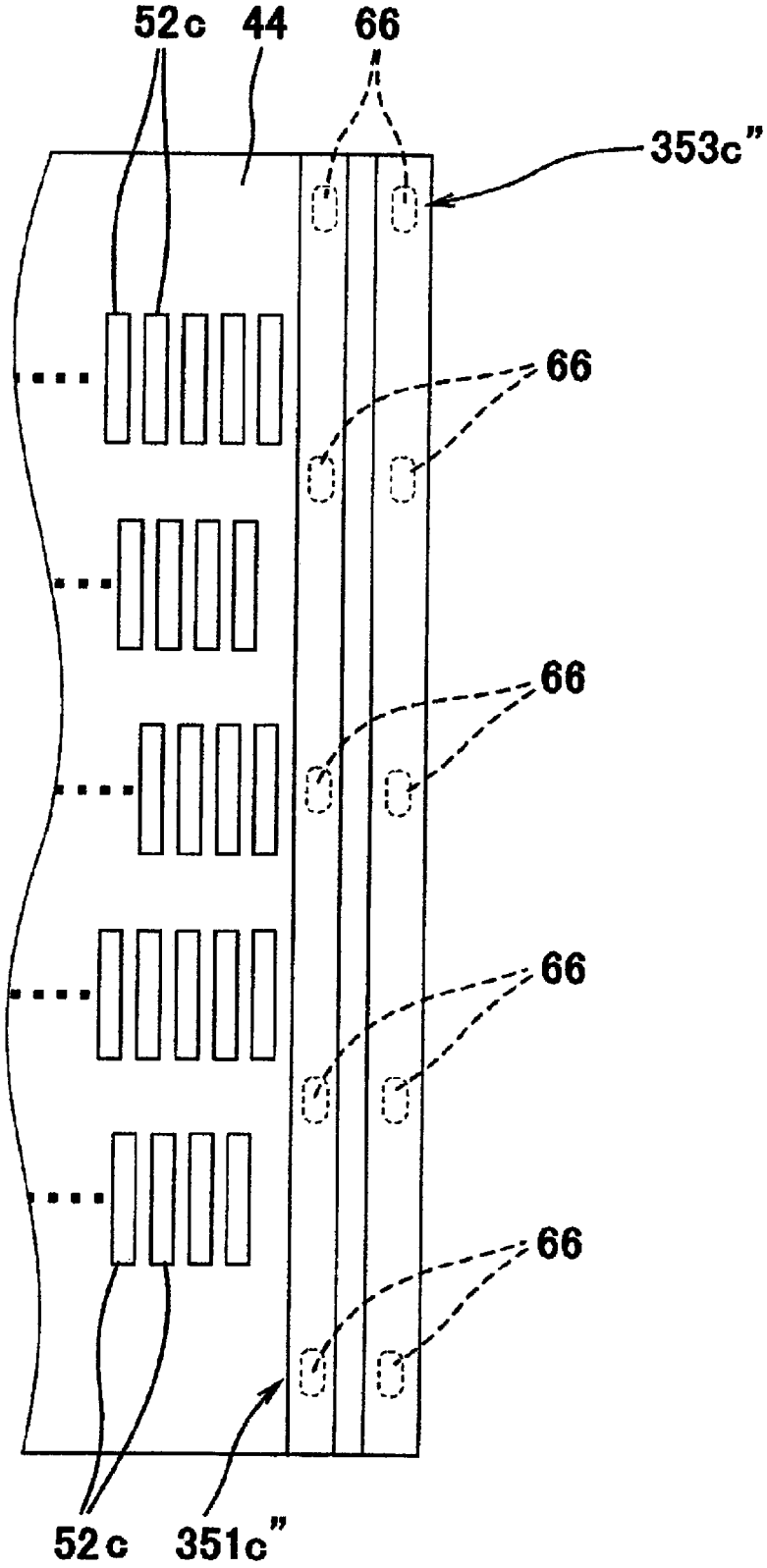

FIGS. 15A and 15B show variants of this embodiment in configuration. In the configuration example shown in FIG. 15A, the first terminal 351*c*' of the first electrode 51 and the third terminal 353*c*' of the third electrode 53 are provided side by side in the vicinity of short sides of the upper surface of the fourth ceramic layer 44 so as to extend in the long side direction. In this modified configuration example, the first and third terminals 351*c*', 353*c*' have no protruding part, but as in the configuration example shown in FIG. 13, the brazing materials 66 are alternately arranged so as to shift to each other in the long side direction. This can prevent bridging of the brazing material 66. In FIG. 15B, as in the configuration example shown in FIG. 15A, a first terminal 351*c*" of the first electrode 51 and a third terminal 353*c*" of the third electrode 53 are provided side by side in the vicinity of short sides of the upper surface of the fourth ceramic layer 44 so as to extend in the long side direction. In this modified configuration example, the brazing materials 66 welded to the first and third terminals 351*c*", 353*c*" are provided at the same position in the extending direction of the first and third terminals 351*c*", 353*c*". However, as in the configuration example shown in FIG. 13, since the amount of the brazing material 66 is smaller than the amount of the brazing material 66 welded to the second terminal of the second electrode 52, even if the first and third terminals 351*c*", 353*c*" are arranged closely, bridging of the brazing material 66 can be prevented.

Figure 16:
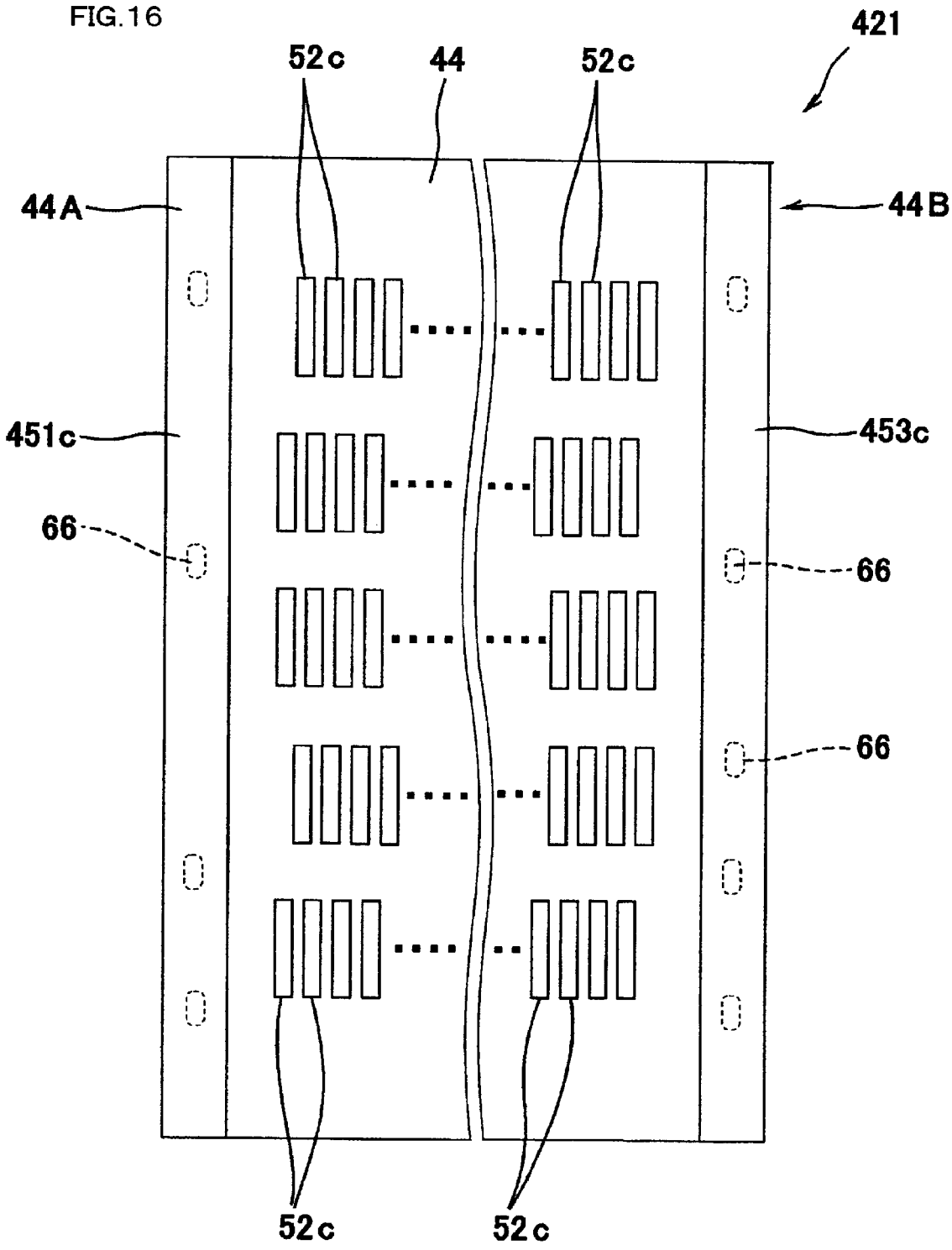
FIG. 16 is a plan view of a piezoelectric actuator in an ink jet head according to a fifth embodiment.
Figure 17:
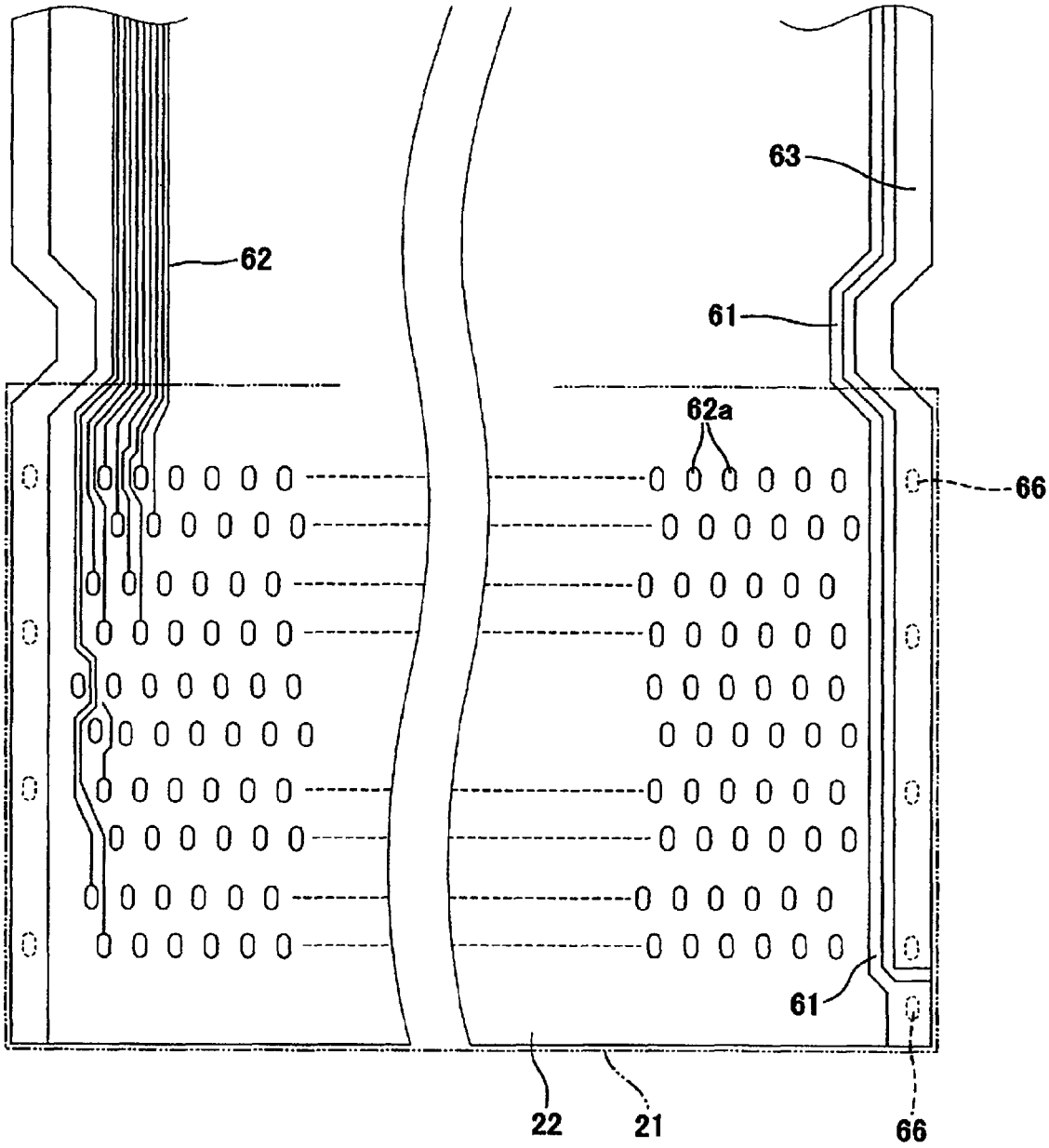
FIG. 17 is a plan view of a wiring substrate in the ink jet head according to the fifth embodiment.

In the fifth embodiment, as shown in FIG. 16, a first terminal 451*c* of the first electrode 51 extends along a first short side 44A of two short sides of the ceramic layer 44 and a third terminal 453*c* of the third electrode 53 extends along a second short side 44B opposed to the first short side 44A of the fourth ceramic layer 44. In relation to this, as shown in FIG. 17, only a first wiring 461 connected to the first terminal 451*c* of the first electrode 51 is provided along one side of the wiring substrate 422 and only a third wiring 463 connected to the third terminal 453*c* of the third electrode 53 is provided along a side opposed to the side of the wiring substrate 422.

By providing only one of the first terminal 451*c* and the third terminal 453*c* in the vicinity of one of short sides, as in the first to third embodiment, the piezoelectric actuator 421 is prevented from increasing in size.

Although these embodiments have been described above, the present invention is not limited to the above-mentioned configuration. For example, arrangement of the first terminal is not limited to that described in each embodiment. A plurality of first terminals may be disposed along the side edge of the piezoelectric actuator. In relation to this, the first wiring may be disposed along both side edges of the wiring substrate in the pulling direction of the wiring substrate or may be disposed along three sides of the wiring substrate in the shape of U. A brazing material such as solder may be used as the conductive material for electrically connecting each terminal to each wiring on the wiring substrate.

Although the plates 31 to 36 of the cavity unit 20 are made of conductive material, at least one plate which contacts ink only needs to be made of conductive material.

The liquid discharge apparatus can be applied to the ink jet head as well as apparatuses for discharging various liquid to form an electrical wiring pattern or color filter.

The piezoelectric actuator 21 is not limited to the above-mentioned embodiments, and the polarizing direction in the ceramics layers may be different from the direction in which voltage is applied to the electrodes. For example, shearing deformation may occur in the ceramics layers by applying voltage so that electric field slants with respect to the polarizing direction in the ceramics layers.

Although the piezoelectric actuator 21 and the ceramics layers 41 to 45 constructing the piezoelectric actuator 21 are rectangular sheets in the drawings, these are not limited to this. For example, these may have any shapes according to the design of the ink jet head, such as a trapezoid shape or a circular shape.

In these embodiments, pressure can be selectively applied to liquid in a plurality of pressure chambers, thereby discharging the liquid. Since the first electrode is provided over the plurality of pressure chambers, any defect in the plurality of pressure chambers on the first ceramic layer can be detected.

In these embodiments, through the first, second and third terminals provided on the insulating layer, it is possible to apply voltage for discharging liquid and detect the existence of the defect on the ceramic layer.

In these embodiments, through wiring substrate having the first, second and third wirings, it is possible to apply voltage for discharging liquid and detect the existence of the defect on the ceramic layer.

In these embodiments, by displacement of the plurality of second and third ceramic layers which are each sandwiched between the plurality of second and third electrodes, large discharge pressure can be obtained. Since the plurality of third wirings connected to the third terminal has a lower electric resistance value than the plurality of first wirings connected to the first terminal, the impedance can be kept in balance and the defect in the ceramic layer can be detected as described above without impairing the characteristic of the liquid discharge apparatus.

In these embodiments, since the conductive member does not contact the first electrode, with the configuration in which the cavity unit, the piezoelectric actuator and the wiring substrate are assembled and the conductive member is provided, by measuring electrical characteristic between the first wiring and the third wiring, the existence of the defect in the first ceramic layer can be detected. Thus, downstream of the manufacturing process, the existence of the defect occurring when the cavity unit, the piezoelectric actuator and the wiring substrate are assembled can be detected, resulting in improvement in reliability of selecting a defective product from all products.

In these embodiments, even after the conductive member is provided on sides of the plurality of ceramic layers and the cavity unit and the piezoelectric actuator are assembled, the third electrode can be easily connected to the cavity unit. Since the contact prevention part provided at the first electrode is a part partially cut out so as not to be exposed in the region where the conductive member is provided, the contact prevention part can be easily manufactured.

In these embodiments, since the amount of the first and third conductive bumps is small, when the bumps are welded to the first and third terminals, the possibility that the first and third bumps bridge to each other can be lowered. Thus, even after the wiring substrate is provided on the piezoelectric actuator, the first wiring and the third wiring are held individualy and the defect can be reliably measured by using the first and third wirings.

In these embodiments, since the first terminal and the third terminal are arranged along one edge of the piezoelectric actuator and the first and third conductive bumps are alternately provided in the extending direction of the first and third terminals, the possibility that the first and third conductive bumps bridge to each other can be further lowered.

In these embodiments, the protruding part of one terminal is opposed to a narrower part between adjacent protruding parts of the other terminal and the protruding parts of both terminals are alternately provided in the extending direction of the terminals. Thus, a sufficient area where the bumps are welded to the protruding parts can be ensured and a region in the piezoelectric actuator where the first terminal and the third terminal are provided can be made compact in the aligning direction of the first and third terminals, thereby preventing the piezoelectric actuator from increasing in size.

In these embodiments, the first terminal is provided along one edge of the insulating layer and the third terminal is provided along a edge opposite to the one edge. The first terminal and the third terminal are separately provided along one edge of the insulating layer. In each case, the region where the terminals are provided can be made compact in the direction perpendicular to the one edge, thereby preventing the piezoelectric actuator from increasing in size.

In these embodiments, an electrical characteristic between the first electrode and the cavity unit can be measured between the first wiring and the third wiring in the state where the cavity unit, the piezoelectric actuator and the wiring substrate are assembled. Accordingly, downstream of the manufacturing process, the defect occurring when the cavity unit, the piezoelectric actuator and the wiring substrate are assembled can be detected, resulting in improvement in reliability of selecting a defective product from all products.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A liquid discharge apparatus, comprising:

a cavity unit including a nozzle for discharging liquid and a pressure chamber which communicates with the nozzle and has an opening; and a piezoelectric actuator which includes a first ceramic layer covering the opening of the pressure chamber, second and third ceramic layers sequentially stacked on the side opposite to the side on which the first ceramic layer covers the opening, a first electrode disposed between the first ceramic layer and the second ceramic layer, a second electrode disposed between the second ceramic layer and the third ceramic layer and a third electrode sandwiching the third ceramic layer with the second electrode, and said piezoelectric actuator being fixed to the cavity unit, wherein the piezoelectric actuator is displaced by applying voltage between the first electrode and the second electrode and between the second electrode and the third electrode, thereby applying discharge pressure to liquid filled in the pressure chamber, the first electrode and the third electrode are connected to at least two terminals which are provided on the piezoelectric actuator, and independent of each other on the piezoelectric actuator electrically, respectively.

2. The liquid discharge apparatus according to claim 1, wherein the second ceramic layer and the third ceramic layer are symmetrically polarized with respect to the second electrode and by applying voltage in the polarizing direction between the first electrode and the second electrode and between the second electrode and the third electrode, the second ceramic layer and the third ceramic layer are displaced.

3. The liquid discharge apparatus according to claim 1, wherein a plurality of the nozzles are provided, a plurality of the pressure chambers corresponding to the plurality of nozzles are provided, the first, second and third ceramic layers are provided over the plurality of pressure chambers, the second electrode is located as opposed to each pressure chamber, and the first electrode and the third electrode are provided over the plurality of pressure chamber.

4. The liquid discharge apparatus according to claim 1, wherein the piezoelectric actuator further comprises an insulating layer which sandwiches the third electrode with the third ceramic layer and has one of the at least two terminals as a first terminal, second terminal and the other of the at least two terminals as a third terminal connected to the first electrode, the second electrode and the third electrode, respectively.

5. The liquid discharge apparatus according to claim 4, further comprising a wiring substrate which sandwiches the insulating layer with the third electrode and has a first wiring, a second wiring and a third wiring connected to the first terminal, the second terminal and the third terminal, respectively.

6. The liquid discharge apparatus according to claim 5, wherein a plurality of the second ceramic layers and third ceramic layers, and a plurality of the second electrodes and third electrodes are alternately stacked, the second terminal is connected to the plurality of second electrodes in the stacking direction and the third terminal is connected to the plurality of third electrodes in the stacking direction, and the third wiring has an electric resistance value lower than the first wiring.

7. The liquid discharge apparatus according to claim 5, further comprising a conductive member for grounding and electrically connecting the third terminal to the cavity unit, wherein the first electrode is provided with a contact prevention part for preventing contact with the conductive member.

8. The liquid discharge apparatus according to claim 7, wherein the third electrode has an exposed part exposed from between the ceramic layers, the conductive member is provided on sides of the first, second and third ceramic layers from the exposed part to the cavity unit in the stacking direction, and the contact prevention part is a part partially cut out so that the first electrode may not be exposed to the region where the conductive member is provided from between the first ceramic layer and the second ceramic layer.

9. The liquid discharge apparatus according to claim 5, wherein the first, second and third terminals are connected to the first, second and third wirings, respectively, through first, second and third conductive bumps provided on the first, second and third wirings, respectively, the amount of the first conductive bump and the third conductive bump is smaller than that of the second conductive bump.

10. The liquid discharge apparatus according to claim 9, wherein the first terminal and the third terminal are provided side by side so as to extend along one edge of the insulating layer, the first wiring and the third wiring corresponding to the first terminal and the third terminal are provided in the extending direction of the first terminal and the third terminal, and the first conductive bump and the third conductive bump are provided so as to shift to each other in the extending direction of the first and third wirings.

11. The liquid discharge apparatus according to claim 10, wherein the plurality of first conductive bumps and the plurality of third conductive bumps are provided so as to be separated from each other in the extending direction of the first and third wirings, the first terminal has protruding parts protruding toward the third terminal at the positions where the plurality of first conductive bumps are provided and a part between adjacent protruding parts is smaller than the protruding part in width in the direction perpendicular to the extending direction of the first wiring, and the third terminal has protruding parts protruding toward the first terminal at the positions where the plurality of third conductive bumps are provided and a part between adjacent protruding parts is smaller than the protruding part in width in the direction perpendicular to the extending direction of the third wiring.

12. The liquid discharge apparatus according to claim 5, wherein the first terminal extends along one edge of the insulating layer, and the third terminal extends along an edge opposite to the one edge of the insulating layer.

13. The liquid discharge apparatus according to claim 5, wherein the first terminal and the third terminal are provided in the vicinity of one edge of the insulating layer and separated from each other along the one edge.

* * * * *